US007000274B2

(12) United States Patent
Matthews Brown et al.

(10) Patent No.: US 7,000,274 B2
(45) **Date of Patent: *Feb. 21, 2006**

(54) SLIPCOVERS FOR SUPPORT PILLOWS

(75) Inventors: Susan H. Matthews Brown, Evergreen, CO (US); Sheila Littlehorn, Littleton, CO (US)

(73) Assignee: The Boppy Company, Golden, CO (US)

( * ) Notice: Subject to any disclaimer, the term of this patent is extended or adjusted under 35 U.S.C. 154(b) by 61 days.

This patent is subject to a terminal disclaimer.

(21) Appl. No.: 10/789,784

(22) Filed: Feb. 27, 2004

(65) Prior Publication Data

US 2004/0200004 A1 Oct. 14, 2004

Related U.S. Application Data

(63) Continuation-in-part of application No. 10/638,058, filed on Aug. 7, 2003, now Pat. No. 6,851,143, which is a continuation of application No. 10/241,504, filed on Sep. 10, 2002, now Pat. No. 6,625,828, which is a continuation of application No. 09/802,310, filed on Mar. 8, 2001, now Pat. No. 6,453,493.

(51) Int. Cl.
*A47G 9/10* (2006.01)

(52) U.S. Cl. ..... 5/636; 5/490; 5/655; 5/645

(58) Field of Classification Search ..... 5/636–645, 5/655, 485, 490, 907
See application file for complete search history.

(56) References Cited

U.S. PATENT DOCUMENTS

| | | | | |
|---|---|---|---|---|
| 1,212,515 | A * | 1/1917 | Leavitt | 5/636 |
| 1,898,272 | A | 2/1933 | Stern | |
| 2,078,022 | A | 4/1937 | Roemer | |
| 2,379,340 | A | 6/1945 | Corbett | |
| 2,522,120 | A * | 9/1950 | Kaskey et al. | 5/636 |
| 3,378,948 | A | 4/1968 | Gervaise | |
| 4,197,604 | A | 4/1980 | Nakamura | |
| 4,236,264 | A | 12/1980 | Britzman | |
| 4,345,347 | A | 8/1982 | Kantor | |
| 4,731,890 | A | 3/1988 | Roberts | |
| 4,914,765 | A | 4/1990 | Smith | |
| 5,148,564 | A | 9/1992 | Reder | |
| 5,154,649 | A | 10/1992 | Pender | |
| 5,184,362 | A * | 2/1993 | Yager et al. | 5/490 |
| 5,193,235 | A | 3/1993 | Kircher | |
| 5,207,791 | A | 5/1993 | Scherbarth | |
| 5,261,134 | A | 11/1993 | Matthews | |
| 5,519,906 | A | 5/1996 | Fanto-Chan | |
| 5,546,620 | A * | 8/1996 | Matthews | 5/655 |
| 5,581,833 | A | 12/1996 | Zenoff | |

(Continued)

FOREIGN PATENT DOCUMENTS

| | | |
|---|---|---|
| FR | 2379268 | 9/1978 |

(Continued)

*Primary Examiner*—Michael Trettel
(74) *Attorney, Agent, or Firm*—Townsend and Townsend and Crew LLP

(57) ABSTRACT

A support pillow comprises a cushion body having a medial region and two opposing arms that define a generally open well, with the cushion body having an outer periphery and an inner periphery adjacent the well. A shell encompasses the cushion body. A fabric cover is removably disposed over the shell such that the fabric cover generally conforms to the shell. The fabric cover defines an opening to permit the cover to be placed over the shell, and the fabric covering includes at least one fastener to close the opening once the cover has been placed over the shell.

10 Claims, 20 Drawing Sheets

U.S. PATENT DOCUMENTS

| | | | | |
|---|---|---|---|---|
| 5,661,861 | A | 9/1997 | Matthews | |
| 6,038,720 | A | 3/2000 | Matthews et al. | |
| 6,055,687 | A | 5/2000 | Matthews | |
| 6,061,854 | A * | 5/2000 | Crowley | 5/655 |
| 6,119,873 | A | 9/2000 | Matthews | |
| 6,230,349 | B1 * | 5/2001 | Silver et al. | 5/636 |
| 6,233,767 | B1 | 5/2001 | Horowitz | |
| 6,453,493 | B1 * | 9/2002 | Matthews Brown | 5/636 |
| 6,499,165 | B1 * | 12/2002 | Morgillo | 5/655 |

FOREIGN PATENT DOCUMENTS

| | | |
|---|---|---|
| GB | 1508809 | 4/1978 |
| WO | WO94/09689 | 5/1994 |

* cited by examiner

Fig. 1
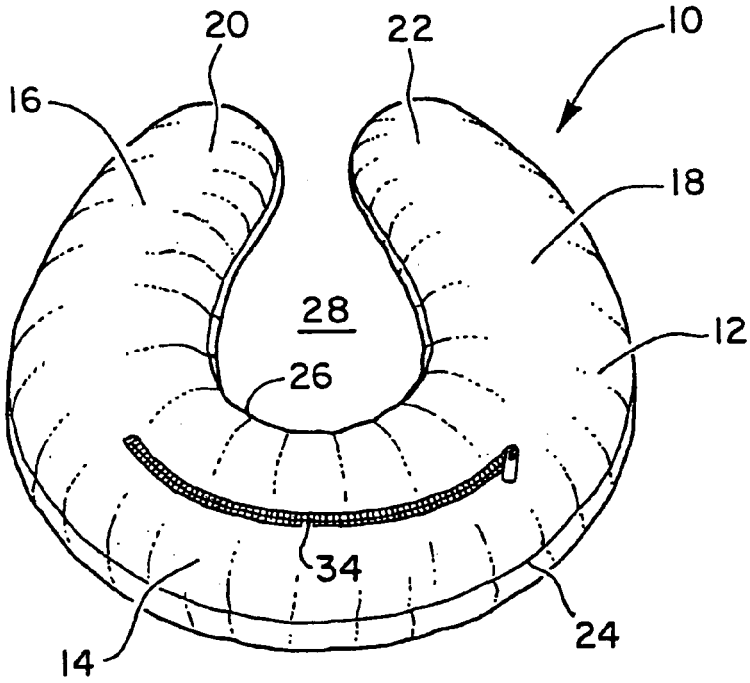
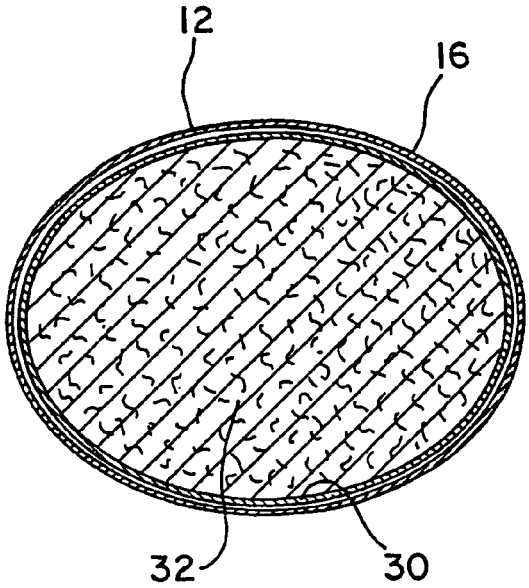
Fig. 2

Fig. 7
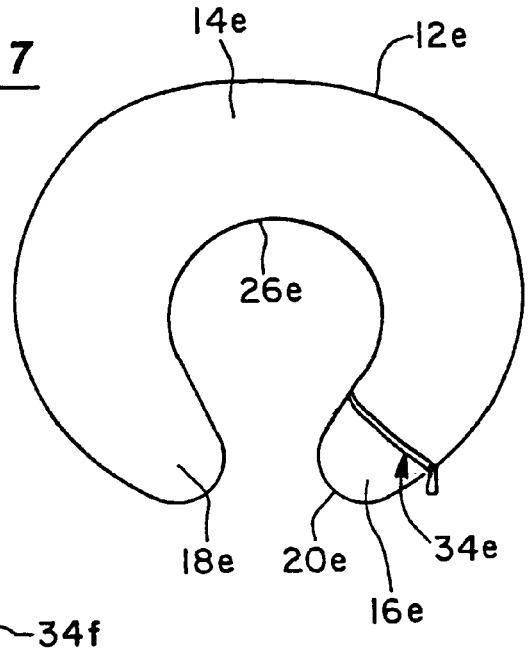
Fig. 8
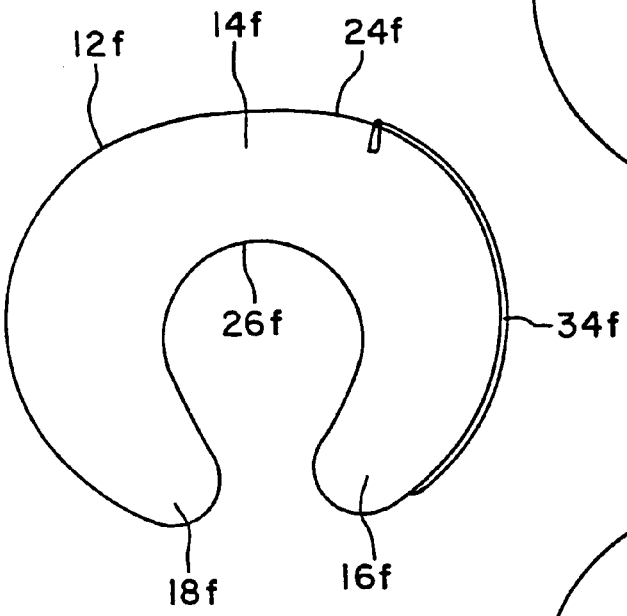
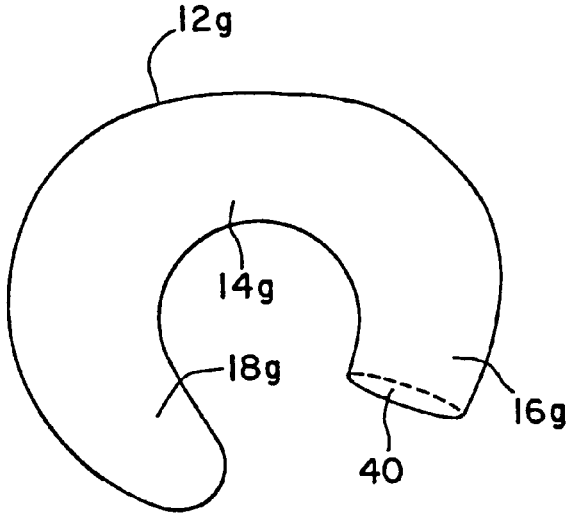
Fig. 9A
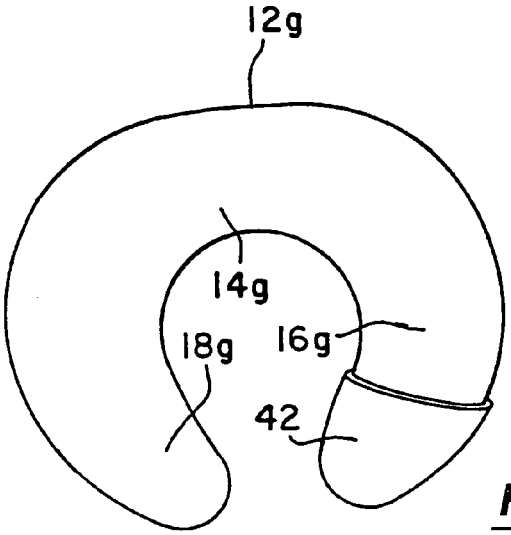
Fig. 9B

SLIPCOVERS FOR SUPPORT PILLOWS

CROSS REFERENCES TO RELATED APPLICATIONS

This application is a continuation in part application and claims the benefit of U.S. application Ser. No. 10/638,058, filed Aug. 7, 2003, now U.S. Pat. No. 6,851,143 which is a continuation application of U.S. application Ser. No. 10/241,504, filed Sep. 10, 2002 (now U.S. Pat. No. 6,625,828), which is a continuation application of U.S. application Ser. No. 09/802,310, filed Mar. 8, 2001 (now U.S. Pat. No. 6,453,493, the complete disclosures of which are herein incorporated by reference.

BACKGROUND OF THE INVENTION

This invention relates generally to the field of support pillows, and in particular to covers for support pillows. More specifically, the invention relates to removable covers for support pillows so that a single support pillow can be modified simply by substituting one cover with another cover.

Support pillows have gained widespread acceptance in a variety of applications. For example, support pillows are now commonly used to support infants and babies in certain positions. Support pillows are also used to provide back support, to facilitate nursing, to support objection in front of a person, and the like. Such uses are described in, for example, U.S. Pat. Nos. 5,261,134; 5,661,861; 6,038,720; 6,055,687; 6,119,873; and 5,546,620, the complete disclosures of which are herein incorporated by reference.

Some support pillows are constructed of a filler material that is stuffed into a fabric shell. This shell may be completely closed, such as with a sewn seam, to prevent the filler material from inadvertently being removed. The fabric shell may be decorated with a variety of colors and/or patterns.

This invention is related to covers for these and other types of support pillows so that the decorative and/or utilitarian functionally of such pillows may to easily be varied.

SUMMARY OF THE INVENTION

The invention provides exemplary covers for support pillows and methods for their use. With such covers, a single support pillow can be modified to have different colors, designs, textures, or the like as well as different utilitarian functions.

In one embodiment, the covers are useful with a cushion body having a medial region and two opposing arms that define a generally open well. The cushion body further includes an outer periphery and an inner periphery adjacent the well, with each of the arms terminating in an end. A shell encompasses and in some cases tightly conforms to the cushion body. With such support pillows, the fabric cover may be constructed so that it may be placed over the shell, with the fabric cover generally conforming to the shape of the pillow body. To facilitate placement of the cover over the pillow, the fabric cover includes an opening into which the pillow may be inserted. The opening in some embodiments may be defined by a seam where the fabric is separated. In one aspect, at least one fastener is provided to close the opening once the cover has been placed over the shell. In this way, a support pillow may be modified simply by inserting the pillow into the opening of the cover and then operating the fastener to close the opening.

The opening may be positioned at a wide variety of locations on the cover. For example, the opening may be located along the outer or inner periphery at the medial region, along the inner periphery on one of the arms, along the outer periphery on one of the arms, across the medial region, along one of the ends, or across one of the arms. In one aspect, the fabric cover may comprise a curved tubular member having two ends, where one of the ends is closed and one of the ends is open to define the opening. Such a cover further includes an end flap to cover the opening, and the fastener is used to couple the end flap to the tubular member.

In another aspect, the cushion body is constructed of a fill material that is compressed or held within the shell. For example, polymer fibers, beads or other fill materials may be held within the interior. In a further aspect, the shell is constructed of a fabric. In some cases, the cover may have a fabric with different colors, textures and/or patterns on each side. In this way, the cover may be reversed to display the other side of the cover. In other cases, different fabrics may be placed on each side.

A variety of fasteners may be used to close the opening. For example, the fastener may comprise a zipper, a hook and loop fastener material, ties, buttons, buckles, snaps, hooks or the like. In one optional aspect, at least one peripheral item may be attached to the cover to vary the utility of the pillow. Conveniently, an attachment mechanism may be used to attach the peripheral item to the cover. Merely by way of example, the peripheral item may comprise a toy and the attachment mechanism may comprise a strap or loop. The peripheral item may also comprise toy bars from which toys may be hung above the pillow. As another example, the peripheral item may comprise a head of a figure, such as an animal head. Other items that may be attached to the cover include handles, pockets, appliques, ties, blankets, bladders, padding layers, and the like.

The invention also provides a method for covering a support pillow that is similar to the support pillows described above. The method further utilizes a cover that is formed from a curved tubular member having an open interior. According to the method, a fastener on the cover is operated to form or expose an opening in the tubular member to provide access to the interior. The support pillow is placed into the interior of the cover through the opening and the cover is manipulated so that the cover covers the shell and generally conforms to the shape of the support pillow. The fastener is then operated to close or cover the opening.

By using such a cover, the fastener may be operated to reform or re-expose the opening, and the cover may be removed from the support pillow. Another cover may then be placed over the support pillow in a similar manner.

A variety of techniques may be used to form the opening. For example, a zipper may be unzipped, a flap may be removed from the cover, or the like. Other examples of fasteners include buttons, snaps, hooks, ties, a hook and loop fastener material and the like. In another aspect, a peripheral item may be attached to the cover. For example, the peripheral item may comprise a toy or a toy bar that may be attached by use of a strap that is attached to the cover. In a further aspect, the opening may be formed across the medial region, along one of the arms, along one of the ends, along the outer or inner periphery, or the like.

BRIEF DESCRIPTION OF THE DRAWINGS

FIG. 1 is a perspective view of one embodiment of a support pillow having a removable cover according to the invention.

FIG. 2 is a cross sectional view of the support pillow and cover of FIG. 1.

FIG. 7 is a top view of one particular embodiment of a pillow cover according to the invention.

FIG. 8 is a top view of a further embodiment of a pillow cover according to the invention.

FIG. 9A is a top view of a pillow cover having an open end according to the invention.

FIG. 9B illustrates the cover of FIG. 9A with an end flap to cover the opening.

DESCRIPTION OF THE SPECIFIC EMBODIMENTS

Figure 3:
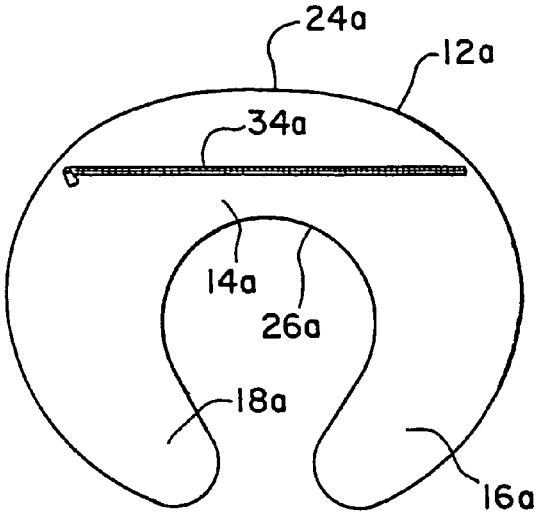
FIG. 3 is a top view of an embodiment of a pillow cover according to the invention.

The invention provides various covers for support pillows. The covers of the invention may be used with a wide variety of support pillows, some of which may have a generally resilient cushion body. The cushion body may be constructed in a variety of ways and of a variety of materials. One way is to stuff a fill material into a flexible shell, such as a fabric tube. Types of fill materials that may be used include fibers, balls, seeds, foamed materials, elastomers and the like. Some examples of such support pillows are described in U.S. Pat. Nos. 5,261,134; 5,661,861; 6,038,720; 6,055,687; 6,119,873; and 5,546,620, incorporated herein by reference. Other types of cushion bodies include inflatable bladders, sponges, and the like.

The support pillows may also have a variety of shapes and sizes. For example, the support pillow may have a horseshoe shape, a "U" shape, a "Π" shape, straight, semi-circular and the like. Shapes for such pillows are also described in U.S. Pat. Nos. 5,261,134; 5,661,861; 6,038,720; 6,055,687; 6,119,873; and 5,546,620, previously incorporated by reference. Such support pillows may include a variety of decorations. For example, such pillows may include a fabric shell having a certain color or pattern.

The covers of the invention are generally flexible and are used to cover the support pillow. The covers may closely or generally conform to the shape of the pillow so that the pillow maintains the same overall appearance. Examples of materials that may be used to construct the cover include fabrics, such as cotton, polyester, nylon and the like, plastics, stretchable materials, such as a mesh fabric, Lycra, and the like. The covers may include one or more openings through which the support pillows are inserted. Conveniently, one or more fasteners may be used to close the opening after the pillow has been inserted. Examples of fasteners that may be used include zippers, a hook and loop fastener material (also know as VELCRO), snaps, buttons, hooks, laces, elastomers, flaps, buckles and the like. In some cases, the covers may include the features described in copending U.S. application Ser. No. 09/679,139, filed Oct. 3, 2000 and 09/802,097, filed Mar. 8, 2001, the complete disclosures of which are herein incorporated by reference.

The covers may have a wide variety of colors, textures, patterns, designs, thicknesses and the like. In this way, an existing support pillow may have its appearance or feel modified simply by placing a cover over the pillow. Also, in some cases, the cover may be reversible so that one cover may be displayed in two different ways. For example, the cover may be made of one type of fabric, but have sides with different colors, textures, patterns or the like. As another example, different fabrics for each side may be used. For instance, a woven fabric may be used on one side, while a wipeable fabric, such as a vinyl or nylon, may be used on the other side.

In some embodiments, the covers may also include various peripheral items that are attached to the covers. Such items can include, for example, toys, teething rings, educational items, pacifiers, play mats, play bars, electronic items such as sound chips, mirrors, writing surfaces, characters, body parts, such as heads, tails, arms legs, and the like, rattles, pockets and the like. Specific examples include three dimensional characters and/or objects, such as a puppy's head, with paws and tails on ends of the arms, a flower and leaves, a clown head with floppy feet and the like.

Optionally, various attachment mechanisms may be used to attach the peripheral items to the cover. Such attachment mechanisms can include, for example, straps, strings, a hook and loop fastener material, snaps, and the like. Another type of peripheral item is a handle for carrying the support pillow. One example of such a handle is described in U.S. Pat. No. 6,434,770, the complete disclosure of which is herein incorporated by reference. By using such peripheral items, the utility of the pillow may be changed simply by using another cover having a different set of items.

Other features of the cover include various pockets, such as external and internal pockets. These may be used to hold items such as bottles, cloths, accessories, aromatherapy packs, sound or vibration units, padding and the like. Also various appliqués may be used. These include decorations or trimming that is made of a material that is attached by sewing, gluing, or the like to another material. Materials that may be used include velvets and tactile, such as textured rubber. Further, the appliqué may represent an object, such as a flower, animal or the like and may depict a cluster or a scene. Other examples include crinkle materials, squeaking devices, pressure sensitive sound chips, gels, and the like. These may be placed between the surface and the material of the appliqué.

Another feature is one or more ties that may be provided at the ends of the arms to tie the arms together. In this way, the ties may be used to hold a small infant in place. Also a harness, straps or the like may also be used to hold the baby in place. In some cases, a pattern may be provided to permit the consumer to make their own cover. The pattern may define a top piece and a bottom piece that may be sewn together to form the cover. Also, kits may be provided to include an embroidery pattern, a paint-by-number design using fabric paints, and the like.

Some covers may be constructed of a disposable material, such as a mesh, light cloth or the like. In this way, the cover may be discarded when soiled. The covers may also include features such as a chalkboard or other writing surface that can be drawn on with chalk or markers, a blanket, a bladder or other padding that may be used to raise the height of the pillow or provide different and/or additional layers of padding, and the like.

Referring now to FIG. 1, one embodiment of a support pillow 10 that is covered by a cover 12 will be described. Pillow 10 may be constructed in a manner similar to those described in U.S. Pat. Nos. 5,261,134; 5,661,861; 6,038,720; 6,055,687; 6,119,873; 6,279,185 and 5,546,620, and copending U.S. application Ser. No. 10/769,007, filed Jan. 29, 2004 incorporated herein by reference. However, the invention is not limited to only this type of support pillow. For example, covers could also be provided for pillows similar to those described in copending U.S. application Ser. No. 10/426,067, filed Apr. 28, 2003, Ser. No. 10/612,266, filed Jul. 1, 2003, Ser. No. 10/612,267, filed Jul. 1, 2003, and Ser. No. 10/627,542, filed Jul. 25, 2003, the complete disclosures of which are herein incorporated by reference.

Pillow 10 has a medial region 14 and two opposing arms 16 and 18 that terminate in ends 20 and 22. Pillow 10 further includes an outer periphery 24 and inner periphery 26 that defines a generally open well 28. As shown, outer periphery 24 and inner periphery 26 have a curved geometry and ends 20 and 22 are generally rounded.

FIG. 2 is a cross sectional view of pillow 10 and cover 12 taken along one of the arms. Pillow 10 is constructed of a shell 30 that is filled or stuffed with a fill material 32, such as hypo allergenic fiber fill material. Shell 30 is filled with enough fill material 32 so that pillow 10 is firm and does not droop or sag during handling. Shell 30 completely encloses fill material 32 so as to prevent its removal.

Cover 12 closely conforms to the shape of pillow 10 so that pillow 10 maintains the same overall shape and appearance as shown. Cover 12 further includes a zipper 34 that may be unzipped to form an opening through which pillow 10 is inserted. Because of the tight fit, cover 12 may be manipulated until it properly covers pillow 10. Zipper 34 may then be zipped to close the opening. As previously described, cover 12 may have a wide variety of colors, textures and the like to vary the appearance or feel of pillow 10.

Cover 12 may be modified to vary the location of zipper 34 (or other fastener). Examples of such variation are illustrated in FIGS. 3–8. For convenience of discussion, the covers in these examples (as well as other examples described herein) will use the same reference numerals used to describe cover 12, followed by a certain letter. Shown in FIG. 3 is cover 12*a* having a zipper 34*a* that extends across the top side of medial region 14*a*.

Figure 4:
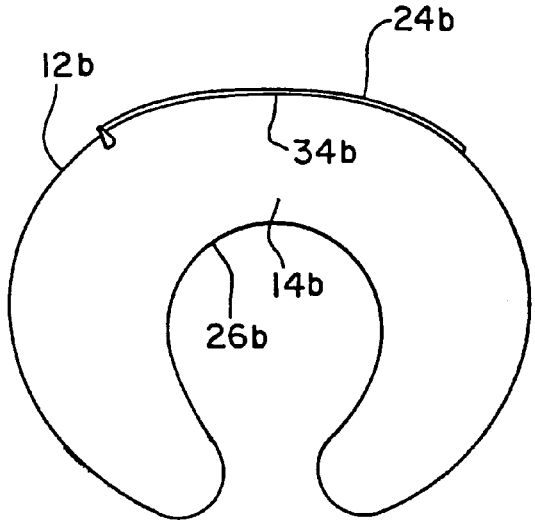
FIG. 4 is a top view of another embodiment of a pillow cover according to the invention.
Figure 5:
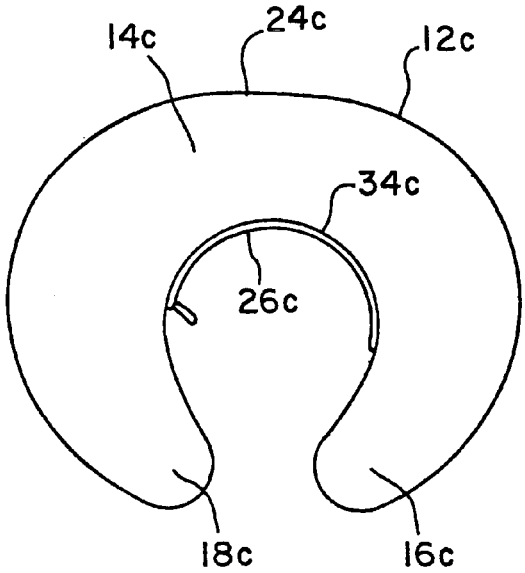
FIG. 5 is a top view of yet another embodiment of a pillow cover according to the invention.
Figure 6:
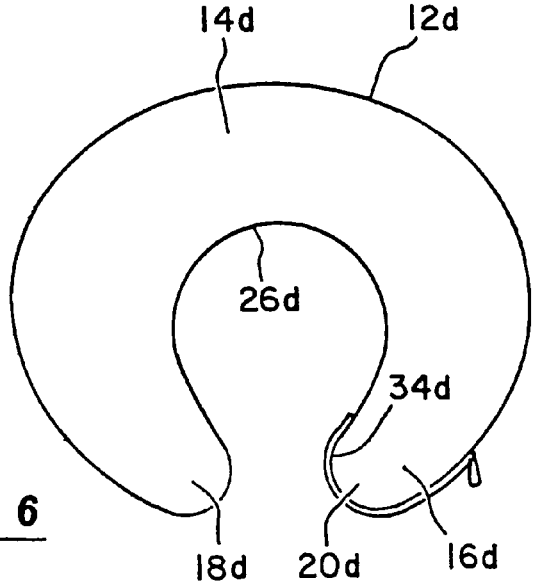
FIG. 6 is a top of still another embodiment of a pillow cover according to the invention.

FIG. 4 illustrates a cover 12*b* having a zipper 34*b* that extends along outer periphery 24*b* at medial region 14*b*. FIG. 5 illustrates a cover 12*c* having a zipper 34*c* that extends along inner periphery 26*c* at medial region 14*c*. FIG. 6 illustrates a cover 12*d* having a zipper 34*d* that extends along end 20*d* of arm 16*d*. FIG. 7 illustrates a cover 12*e* having a zipper 34*e* that extends across the top side of arm 16*e*. Finally, FIG. 8 illustrates a pillow 12*f* having a zipper 34*f* that extends along arm 16*f* at outer periphery 24*f*.

Another embodiment of a cover 12*g* is illustrated in FIGS. 9A and 9B. Cover 12*g* is similar to cover 12*e* of FIG. 7 except that end 20*e* has been removed to leave an opening 40 in arm 16*g*. As shown in FIG. 9B, an end flap 42 is placed over opening 40 to completely enclose the support pillow after the pillow has been inserted through opening 40. A hook and loop fastener material may be used to hold flap 42 to arm 16*g*.

Figure 10:
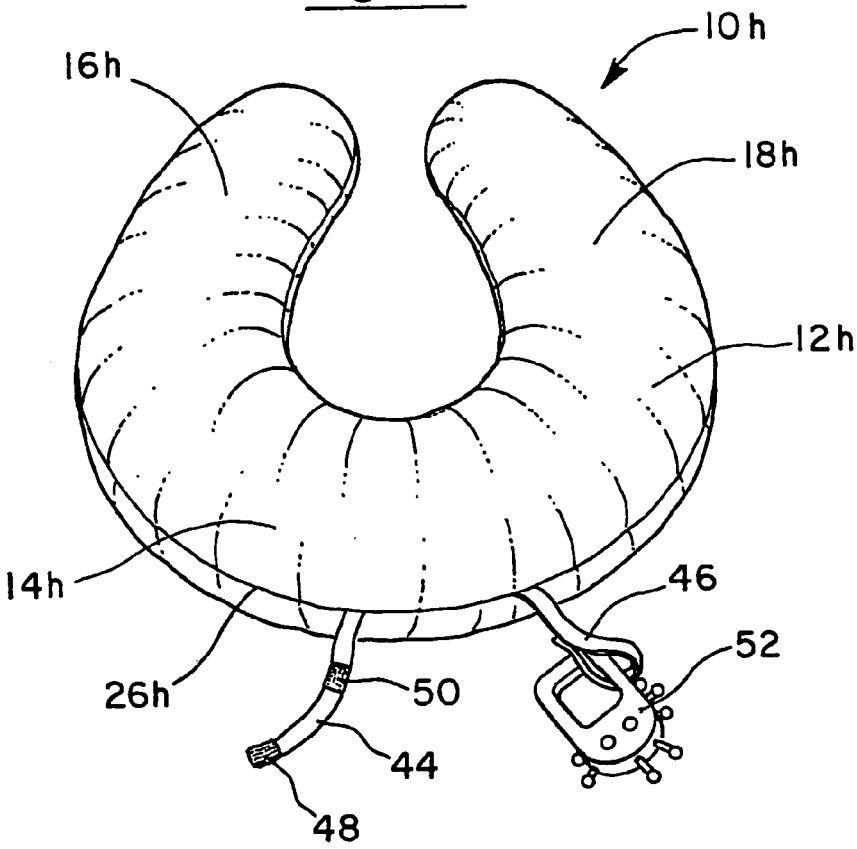
FIG. 10 illustrates a support pillow and cover having straps for attaching items to the cover according to the invention.

FIG. 10 illustrates another modification of support pillow 10 and cover 12 of FIG. 1. For convenience of discussion, similar elements of the support pillow of FIG. 10 and cover will use the same reference numerals, followed by the letter "h". Cover 12*h* has a pair of attachment straps 44 and 46 that are sewn to the seam of outer periphery 24*h*. Straps 44 and 46 include pieces 48 and 50 of a hook and loop fastener material to form loops in straps 44 and 46, it being appreciated that other fasteners may be used. Straps 44 and 46 are used to attach various toys, such as a toy 52, to cover 12*h*. In this way, the utility of pillow 10*h* may be changed simply by attaching different items to the straps. Moreover, other attachment items may be used with the pillow simply by using another cover.

Figure 11:
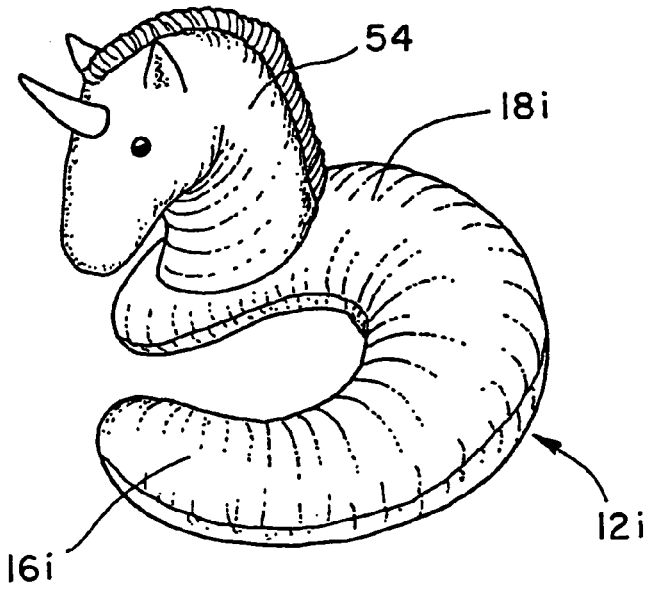
FIG. 11 illustrates a support pillow and cover having an animal head that is attached to the cover according to the invention.

By way of example, FIG. 11 illustrates another embodiment of a cover 12*i* having an animal head 54 attached to end 18*i*. Further, it will be appreciated that other types of figures may be coupled to cover 12*i* and at different locations.

Figure 12:
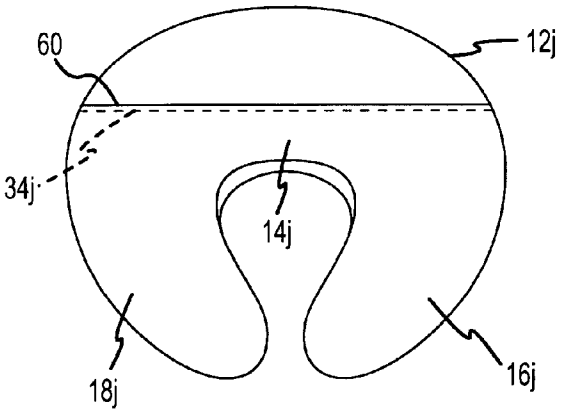
FIG. 12 is a top view of one embodiment of a cover that covers a support pillow, with the cover having a zipper across the medial region.

FIG. 12 illustrates one embodiment of a cover 12*j* covering a pillow. Cover 12*j* has a seam 60 on medial region 14*j* that defines an opening in cover 12*j*. Incorporated into seam 60 is a zipper 34*j* (shown in dashed line). Seam 60 covers zipper 34*j* so that the top surface of cover 12*j* is generally smooth. To access zipper 34*j*, seam 60 may be folded back. By providing seam 60 on the face of medial region 14*j*, a large opening may be provided to facilitate the introduction and removal of the pillow.

Figure 13:
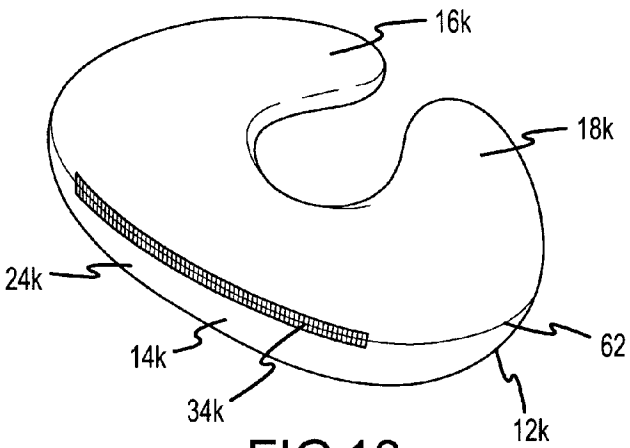
FIG. 13 is a perspective view of one embodiment of a cover that covers a support pillow, with the cover having a zipper along the outer periphery.

FIG. 13 illustrates a cover 12*k* where a zipper 34*k* is incorporated into a seam 62 at the outer periphery 24*k* of medial region 14*k*. At seam 62, two pieces of material that are joined together to form cover 12*k*. Zipper 34*k* may be operated to provide an opening into the interior of cover 12*k*.

Figure 14:
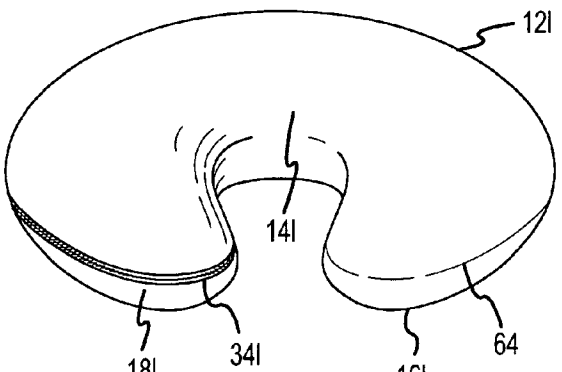
FIG. 14 is a perspective view of one embodiment of a cover that covers a support pillow, with the cover having a zipper along one of the ends.

FIG. 14 illustrates a cover 121 where a zipper 341 is incorporated into a seam 64 at the end of arm 181, it being appreciated that zipper 341 may also be incorporated into end 161. Zipper 341 may be operated to provide an opening into cover 121 at the end of one of the arms to permit the pillow to be inserted or removed.

Figure 15:
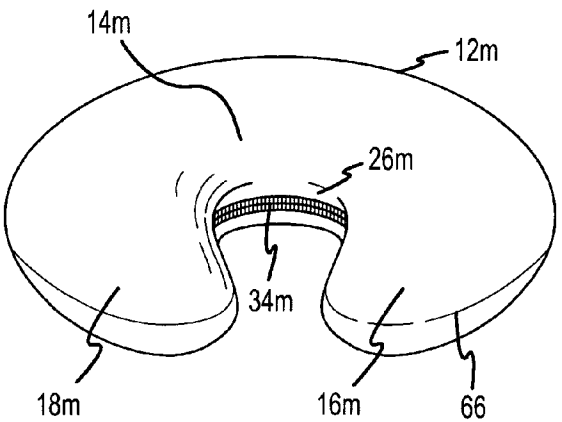
FIG. 15 is a perspective view of one embodiment of a cover that covers a support pillow, with the cover having a zipper along the inner periphery.

FIG. 15 illustrates a cover 12*m* having a zipper 34*m* that is incorporated into a seam 66 at the inner periphery 26*m* of medial region 14*m*. By operating zipper 34*m*, an opening is formed into cover 12*m* to permit the pillow to be inserted or removed.

Figure 16:
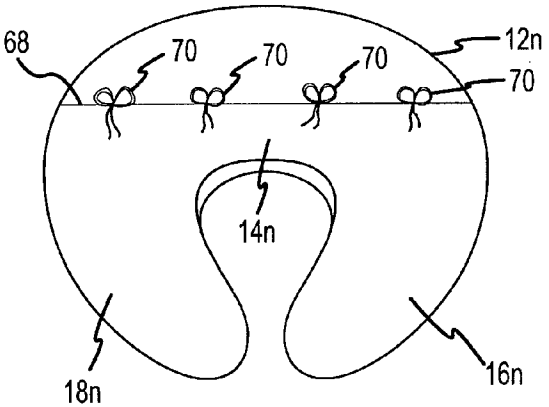
FIG. 16 is a top view of one embodiment of a cover that covers a support pillow, with the cover having ties along the medial region.

FIG. 16 illustrates one embodiment of a cover 12*n* covering a pillow. Cover 12*n* has a seam 68 on medial region 14*n* that defines an opening in cover 12*n*. Coupled to each edge of seam 68 are a plurality of ties 70. By providing seam 66 on the face of medial region 14*n*, a large opening may be provided to facilitate the introduction and removal of the pillow. To provide the opening at seam 68, ties 70 may be untied from each other and seam 68 pulled apart. Once the pillow is in place, ties 70 may be retied. Ties 70 may be constructed from essentially any type of flexible material, such as fabrics, strings and the like.

Figure 17:
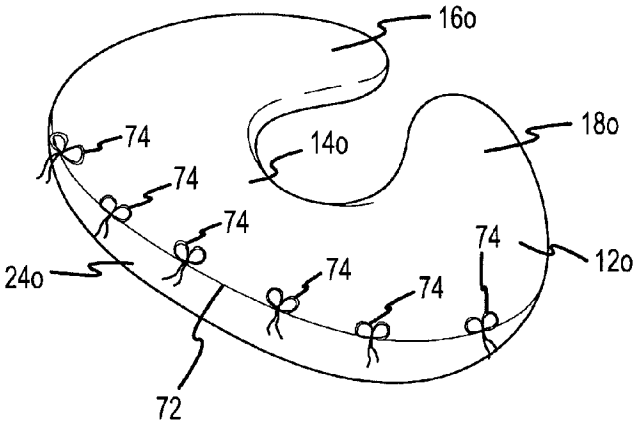
FIG. 17 is a perspective view of one embodiment of a cover that covers a support pillow, with the cover having ties along the outer periphery.

FIG. 17 illustrates a cover 12*o* where ties 74 are coupled to each edge of a seam 72 at the outer periphery 24*o* of medial region 14*o*. At seam 72, two pieces of material that are joined together to form cover 12*o*. Ties 74 may be untied to provide an opening into the interior of cover 12*o*.

Figure 18:
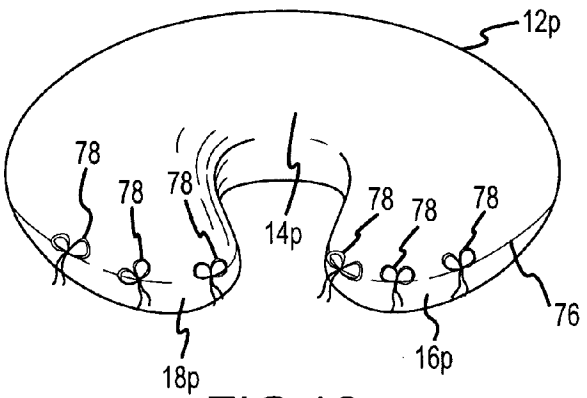
FIG. 18 is a perspective view of one embodiment of a cover that covers a support pillow, with the cover having ties along the ends of the arms.

FIG. 18 illustrates a cover 12*p* where ties 78 are coupled to each edge of a seam 76 at the end of arms 16*p* and 18*p*, it being appreciated that ties 78 may also be incorporated into only one of the ends. Ties 78 may be operated to provide an opening into cover 12*p* at the end of one of the arms to permit the pillow to be inserted or removed.

Figure 19:
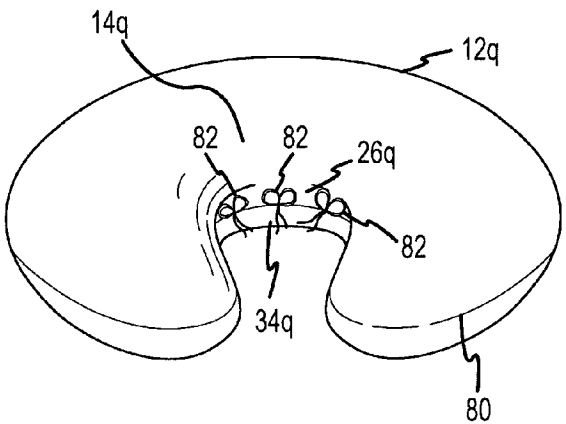
FIG. 19 is a perspective view of one embodiment of a cover that covers a support pillow, with the cover having ties along the inner periphery.

FIG. 19 illustrates a cover 12*q* having ties 82 that are copied to each edge of a seam 80 at the inner periphery 26*q* of medial region 14*q*. By untying ties 82, an opening is formed into cover 12*q* to permit the pillow to be inserted or removed.

Figure 20:
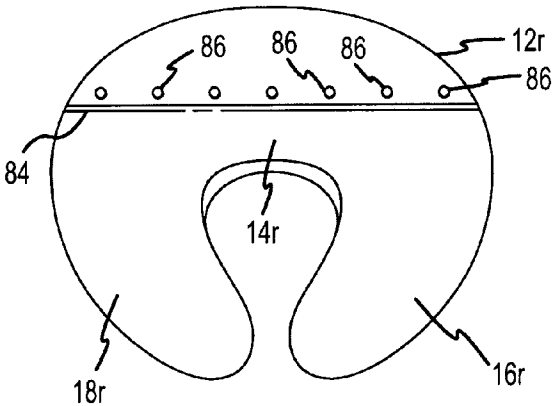
FIG. 20 is a top view of one embodiment of a cover that covers a support pillow, with the cover having buttons along the medial region.

FIG. 20 illustrates one embodiment of a cover 12*r* covering a pillow. Cover 12*r* has a seam 84 on medial region 14*r* that defines an opening in cover 12*r*. Coupled to one edge (such as the bottom edge) of seam 84 are a plurality of buttons 86. The other edge (such as the top edge) includes slits through which buttons 86 pass. By providing seam 84 on the face of medial region 14*r*, a large opening may be provided to facilitate the introduction and removal of the pillow. To provide the opening at seam 84, buttons 86 may be removed from their button holes and seam 84 pulled apart. Once the pillow is in place, buttons 86 may be inserted back through the button holes. Buttons 86 may be constructed from materials such as metal, plastic and the like.

Figure 21:
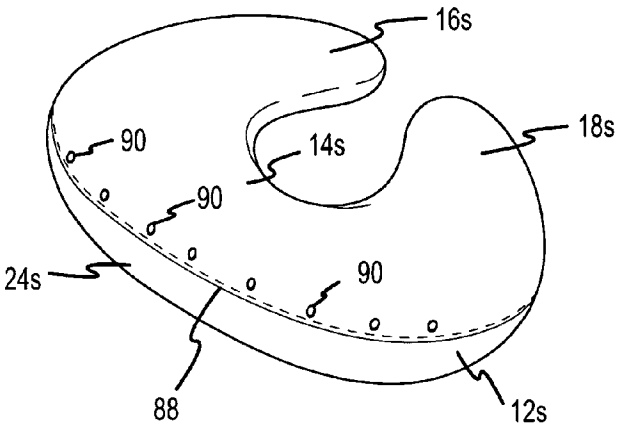
FIG. 21 is a perspective view of one embodiment of a cover that covers a support pillow, with the cover having buttons along the outer periphery.

FIG. 21 illustrates a cover 12*s* where buttons 90 are coupled to one edge of a seam 88 at the outer periphery 24*s* of medial region 14*s*. At seam 88, two pieces of material that are joined together to form cover 12*s*. Buttons 90 may be unbuttoned to provide an opening into the interior of cover 12*s*.

Figure 22:
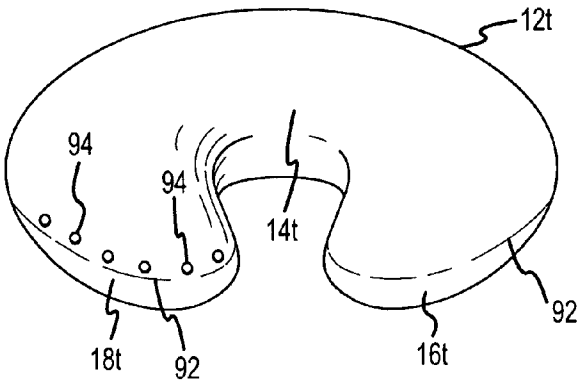
FIG. 22 is a perspective view of one embodiment of a cover that covers a support pillow, with the cover having buttons along the ends of the arms.

FIG. 22 illustrates a cover 12*t* where buttons 94 are coupled to one edge of a seam 92 at the end of one or both arms 16*t* and 18*t*. Buttons 94 may be operated to provide an opening into cover 12*t* at the end of one of the arms to permit the pillow to be inserted or removed.

Figure 23:
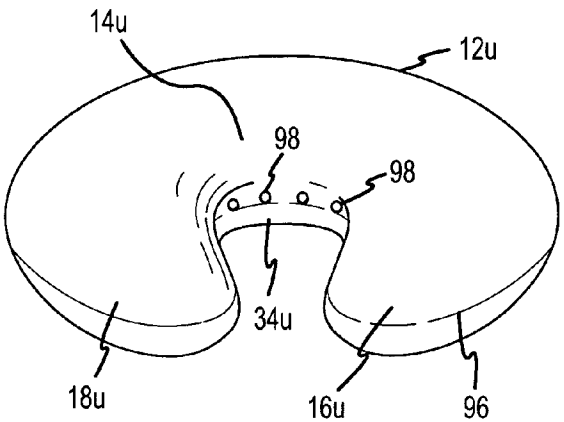
FIG. 23 is a perspective view of one embodiment of a cover that covers a support pillow, with the cover having buttons along the inner periphery.

FIG. 23 illustrates a cover 12*u* having buttons 98 that are coupled to one edge of a seam 96 at the inner periphery 26*u* of medial region 14*u*. By unbuttoning snaps 98, an opening is formed into cover 12*u* to permit the pillow to be inserted or removed.

Figure 24:
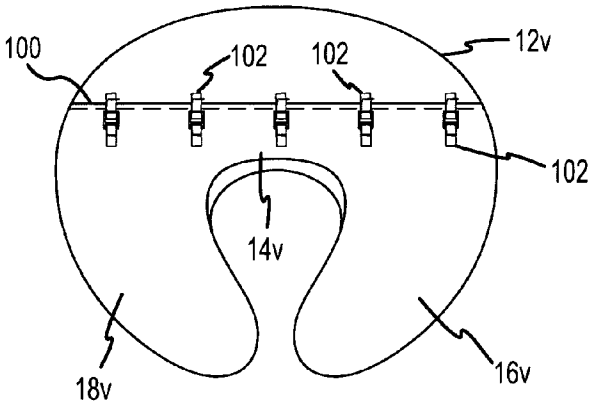
FIG. 24 is a top view of one embodiment of a cover that covers a support pillow, with the cover having buckles along the medial region.

FIG. 24 illustrates one embodiment of a cover 12*v* covering a pillow. Cover 12*v* has a seam 100 on medial region 14*v* that defines an opening in cover 12*v*. Coupled to each edge of seam 100 are a plurality of buckles 102. One piece of each buckle is coupled to one inside edge while the other piece of the buckle is attached to the opposing edge of seam 100. Examples of buckles that may be used include traditional belt buckles, quick release buckles and the like. These may be coupled to the edges of the seam using ties, straps, or the like. For instance, materials such as leather, fabric or nylon straps, strings, ropes and the like may be used to couple the buckles to the cover. By providing seam 100 on the face of medial region 14*v*, a large opening may be provided to facilitate the introduction and removal of the pillow. To provide the opening at seam 100, buckles 102 may be unsnapped from each other and seam 100 pulled apart. Once the pillow is in place, buckles 102 may be connected.

Figure 25:
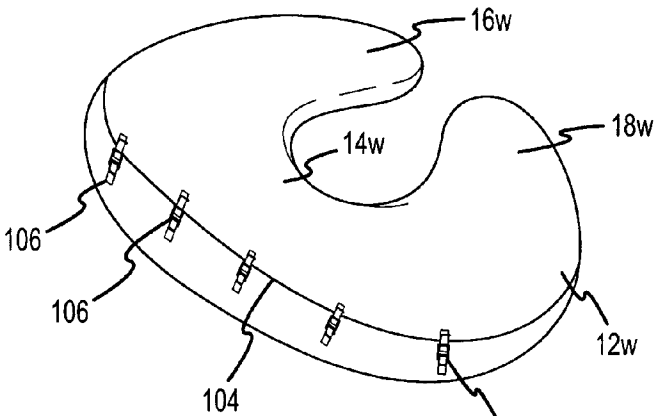
FIG. 25 is a perspective view of one embodiment of a cover that covers a support pillow, with the cover having buckles along the outer periphery.

FIG. 25 illustrates a cover 12*w* where buckles 106 are coupled to each edge of a seam 104 at the outer periphery 24*w* of medial region 14*w*. At seam 104, two pieces of material that are joined together to form cover 12*w*. Buckles 106 may be unbuckled to provide an opening into the interior of cover 12*w*.

Figure 26:
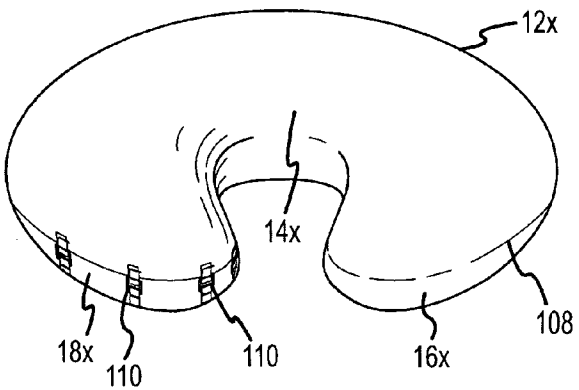
FIG. 26 is a perspective view of one embodiment of a cover that covers a support pillow, with the cover having buckles along the ends of the arms.

FIG. 26 illustrates a cover 12*x* where buckles 110 are coupled to each edge of a seam 108 at the end of one or both arms 16*x* and 18*x*. Buckles 110 may be operated to provide an opening into cover 12*x* at the end of one of the arms to permit the pillow to be inserted or removed.

Figure 27:
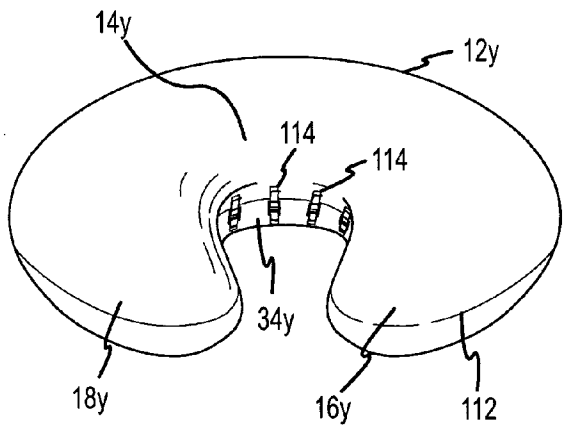
FIG. 27 is a perspective view of one embodiment of a cover that covers a support pillow, with the cover having buckles along the inner periphery.

FIG. 27 illustrates a cover 12*y* having buckles 114 that are coupled to each edge of a seam 112 at the inner periphery 26*y* of medial region 14*y*. By unbuckling buckles 114, an opening is formed into cover 12*y* to permit the pillow to be inserted or removed.

Figure 28:
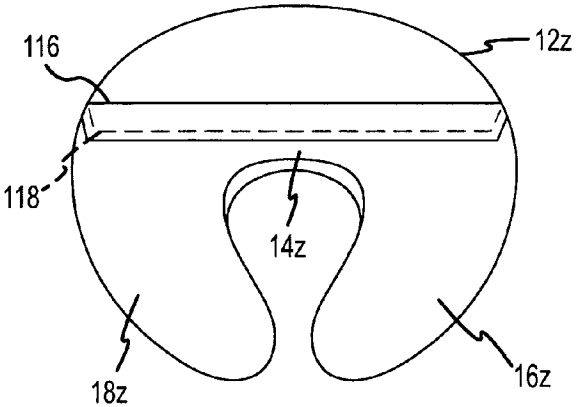
FIG. 28 is a top view of one embodiment of a cover that covers a support pillow, with the cover having a flap with an optional hook and loop fastener material along the medial region.

FIG. 28 illustrates one embodiment of a cover 12*z* covering a pillow. Cover 12*z* has an overlapping seam 116 on medial region 14*z* that forms a flap and defines an opening in cover 12*z*. For example, the flap may overlap about 1 to about 3 inches. Because the edges of the seam overlap, a natural flap is provided to close the opening. To gain access to the interior, the flap may be lifted to expose the opening. Optionally, coupled to each edge of seam 116 may be a hook and loop fastener material 118 (shown in phantom line). One piece of the hook and loop mater may be coupled to one inside edge while the other piece may be attached to the opposing edge of seam 116. By providing seam 116 on the face of medial region 14*z*, a large opening may be provided to facilitate the introduction and removal of the pillow. Once the pillow is in place in the interior, the flap may be smoothed over cover 12*z*, optionally being joined by the hook and loop fastener material.

Figure 29:
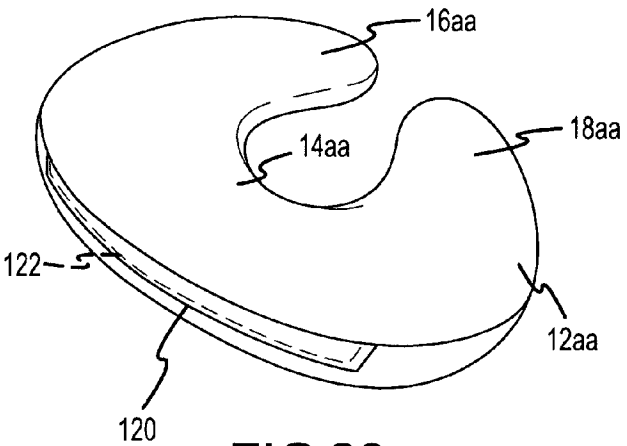
FIG. 29 is a perspective view of one embodiment of a cover that covers a support pillow, with the cover having flap with an optional hook and loop fastener material along the outer periphery.

FIG. 29 illustrates a cover 12*aa* having an overlapping seam 120 that forms a flap at the outer periphery 24*aa* of medial region 14*aa*. At seam 120, two pieces of material that are joined together to form cover 12*aa*. Optionally, a hook and loop fastener material 112 may be coupled to the underside of the flap and to the opposite edge of seam 120 is securely hold the flap to the cover. Seam 120 may be separated to provide an opening into the interior of cover 12*aa*.

Figure 30:
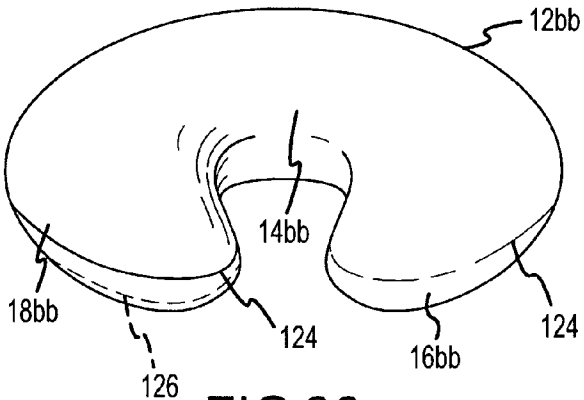
FIG. 30 is a perspective view of one embodiment of a cover that covers a support pillow, with the cover having flap with an optional hook and loop fastener material along the ends of the arms.

FIG. 30 illustrates a cover 12*bb* where an overlapping seam 124 is positioned at the end of one or both arms 16*bb* and 18*bb*. Sean 124 may be separated to provide an opening into cover 12*bb* at the end of one of the arms to permit the pillow to be inserted or removed. Optionally, a hook and loop fastener material 126 may be coupled to the underside of the flap and the opposite side of the seam to securely couple the flap to the cover.

Figure 31:
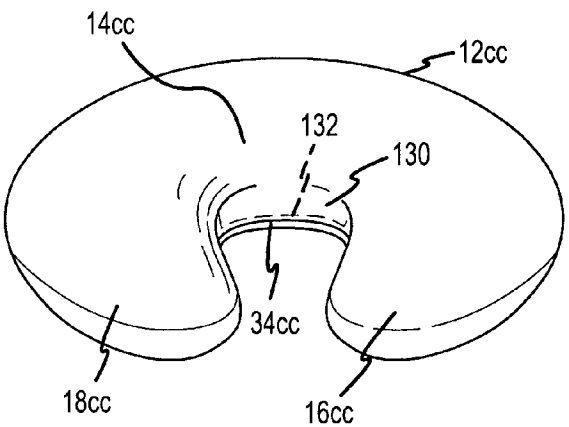
FIG. 31 is a perspective view of one embodiment of a cover that covers a support pillow, with the cover having flap with an optional hook and loop fastener material along the inner periphery.

FIG. 31 illustrates a cover 12*cc* having an overlapping seam 130 at the inner periphery 26*cc* of medial region 14*cc*. By separating seam 130, an opening is formed into cover 12*cc* to permit the pillow to be inserted or removed. Optionally, a hook and loop fastener material 132 may be used to hold the flap closed.

Figure 32:
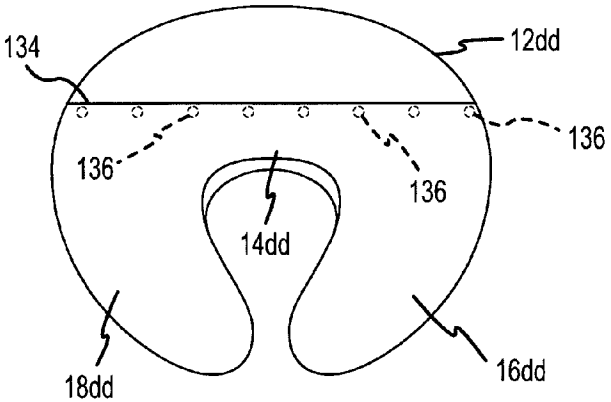
FIG. 32 is a top view of one embodiment of a cover that covers a support pillow, with the cover having snaps along the medial region.

FIG. 32 illustrates one embodiment of a cover 12*dd* covering a pillow. Cover 12*dd* has a seam 134 on medial region 14*dd* that defines an opening in cover 12*dd*. Coupled to each edge of seam 134 are a plurality of snaps 136. The male part of each snap is coupled to one inside edge while the female part of the snap is attached to the opposing edge of seam 134. By providing seam 134 on the face of medial region 14*dd*, a large opening may be provided to facilitate the introduction and removal of the pillow. To provide the opening at seam 134, snaps 136 may be unsnapped from each other and seam 134 pulled apart. Once the pillow is in place, snaps 136 may be snapped. Snaps 136 may be constructed from materials such as metal, plastic and the like.

Figure 33:
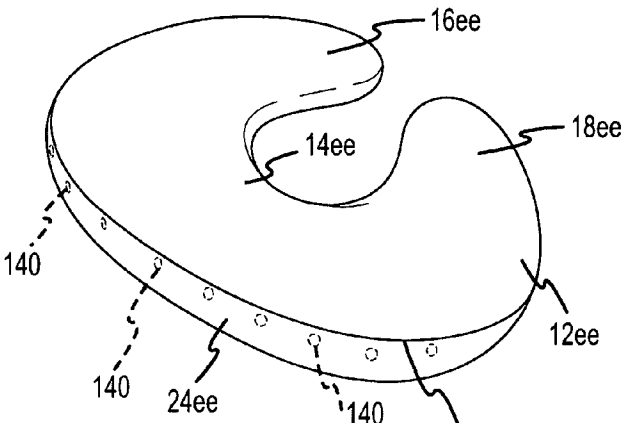
FIG. 33 is a perspective view of one embodiment of a cover that covers a support pillow, with the cover having snaps along the outer periphery.

FIG. 33 illustrates a cover 12*ee* where snaps 140 are coupled to each edge of a seam 138 at the outer periphery 24*ee* of medial region 14*ee*. At seam 138, two pieces of material that are joined together to form cover 12*ee*. Snaps 140 may be unsnapped to provide an opening into the interior of cover 12*ee*.

Figure 34:
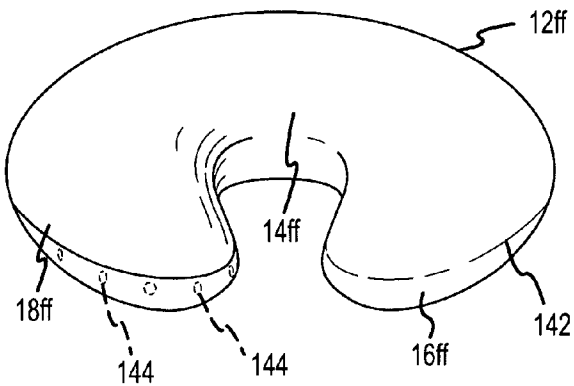
FIG. 34 is a perspective view of one embodiment of a cover that covers a support pillow, with the cover having snaps along the ends of the arms.

FIG. 34 illustrates a cover 12*ff* where snaps 144 are coupled to each edge of a seam 142 at the end of one or both arms 16*ff* and 18*ff*. Snaps 144 may be operated to provide an opening into cover 12*ff* at the end of one of the arms to permit the pillow to be inserted or removed.

Figure 35:
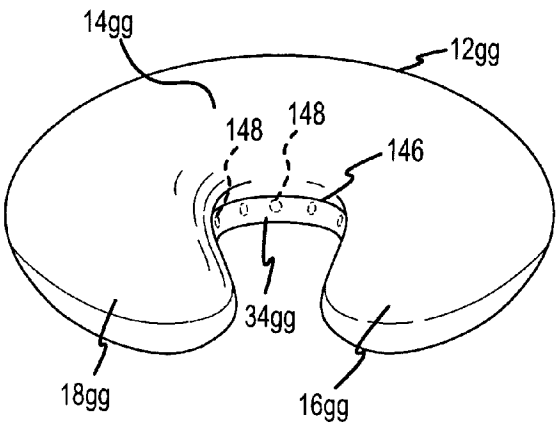
FIG. 35 is a perspective view of one embodiment of a cover that covers a support pillow, with the cover having snaps along the inner periphery.

FIG. 35 illustrates a cover 12*gg* having snaps 148 that are coupled to each edge of a seam 146 at the inner periphery 26*gg* of medial region 14*gg*. By unsnapping snaps 148, an opening is formed into cover 12*gg* to permit the pillow to be inserted or removed.

Figure 36:
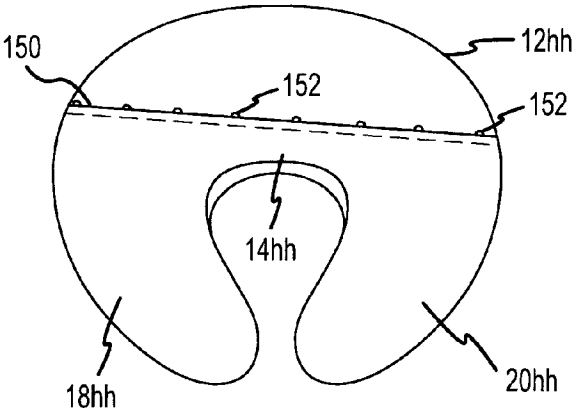
FIG. 36 is a top view of one embodiment of a cover that covers a support pillow, with the cover having hooks along the medial region.

FIG. 36 illustrates one embodiment of a cover 12*hh* covering a pillow. Cover 12*hh* has a seam 150 on medial region 14*hh* that defines an opening in cover 12*hh*. Coupled to each edge of seam 150 are a plurality of hooks 152 that loop over catches on the opposite edge of seam 150. By providing seam 150 on the face of medial region 14*hh*, a large opening may be provided to facilitate the introduction and removal of the pillow. To provide the opening at seam 150, hooks 152 may be unhooked from the catches and seam 150 pulled apart. Once the pillow is in place, hooks 152 may be re-hooked. Hooks 152 may be constructed from materials such as metal, plastic and the like.

Figure 37:
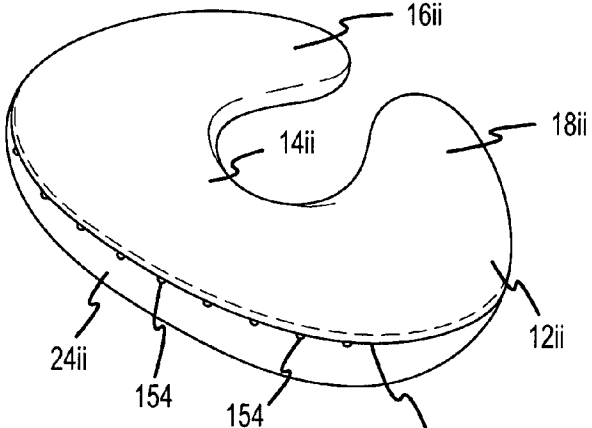
FIG. 37 is a perspective view of one embodiment of a cover that covers a support pillow, with the cover having hooks along the outer periphery.

FIG. 37 illustrates a cover 12*ii* where hooks 154 are coupled to one edge of a seam 156 at the outer periphery 24*ii* of medial region 14*ii* and mate with catches on the other edge of the seam. At seam 156, two pieces of material that are joined together to form cover 12*ii*. Hooks 154 may be un-hooked to provide an opening into the interior of cover 12*ii*.

Figure 38:
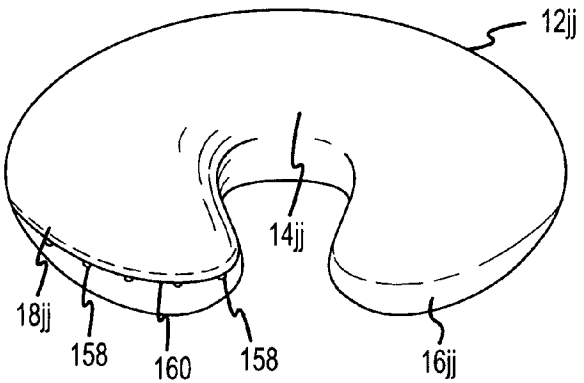
FIG. 38 is a perspective view of one embodiment of a cover that covers a support pillow, with the cover having hooks along the ends of the arms.

FIG. 38 illustrates a cover 12*jj* where hooks 158 are coupled to an edge of a seam 160 at the end of one or both arms 16*jj* and 18*jj*. Hooks 158 may be unhooked to provide an opening into cover 12*jj* at the end of one of the arms to permit the pillow to be inserted or removed.

Figure 39:
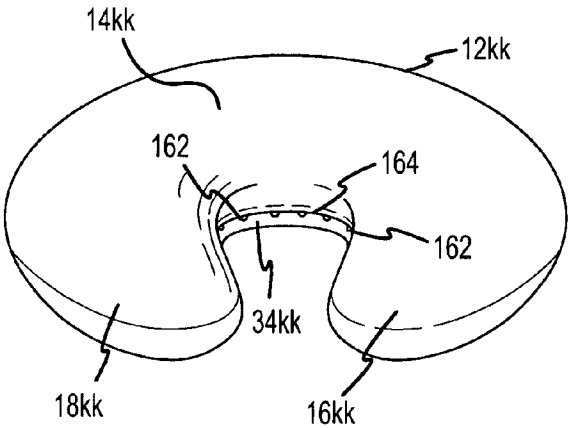
FIG. 39 is a perspective view of one embodiment of a cover that covers a support pillow, with the cover having hooks along the inner periphery.

FIG. 39 illustrates a cover 12*kk* having hooks 162 that are coupled to each edge of a seam 164 at the inner periphery 26*kk* of medial region 14*kk*. By unhooking hooks 162 from their catches, an opening is formed into cover 12*kk* to permit the pillow to be inserted or removed.

Figure 40:
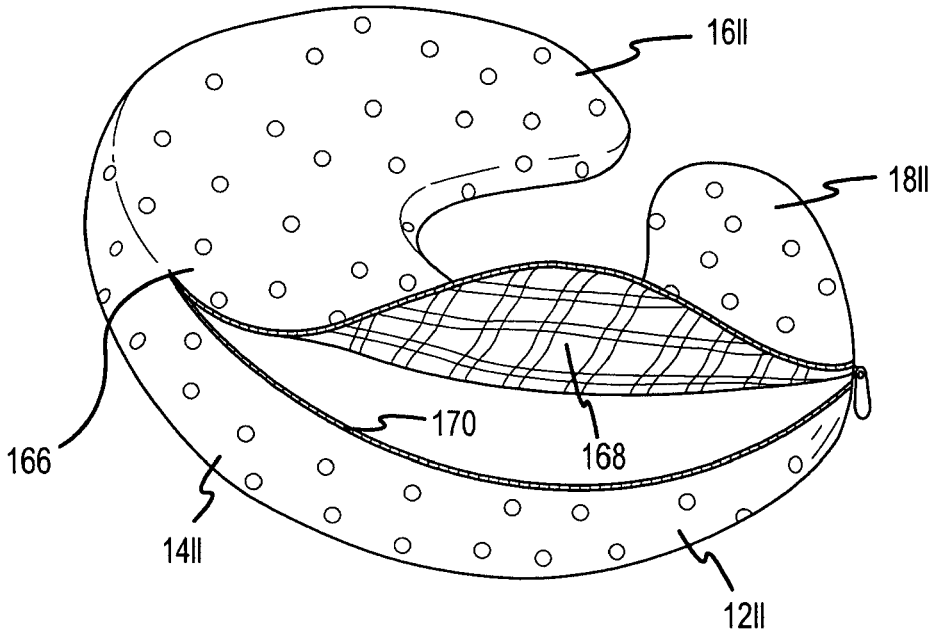
FIG. 40 is a perspective view of one embodiment of a reversible cover.

FIG. 40 illustrates a cover 12*ll* that is constructed of a reversible fabric having two sides 166 and 168. In this way, cover 12*ll* may be turned inside out so that both surfaces may be used with a single pillow. As shown, cover 12*ll* includes a zipper 170. However, it will be appreciated that any of the fasteners described herein which are located at any of the positions may be used. As shown, cover 12*ll* is constructed of a single fabric with different patterns on each side. However, it will be appreciated that different fabrics or materials could be used on each side. In this way, the sides may be varied using different colors, textures, patterns, appliqués and the like. These include woven fabrics, wipeable fabrics (such as vinyl or nylon), and the like.

FIGS. 41–44 illustrate embodiments where handles may be coupled to the cover. The handles may be provided in a variety of locations on the covers using a variety of techniques, including those described in U.S. Pat. No. 6,434,770, incorporated herein by reference. Also, a variety of materials may be used to form the handles, such as ropes, nylon straps, fabrics, plastics, and the like. Attachment schemes may be used include sewing, rivets, snaps, tied ends, gluing and the like.

Figure 41:
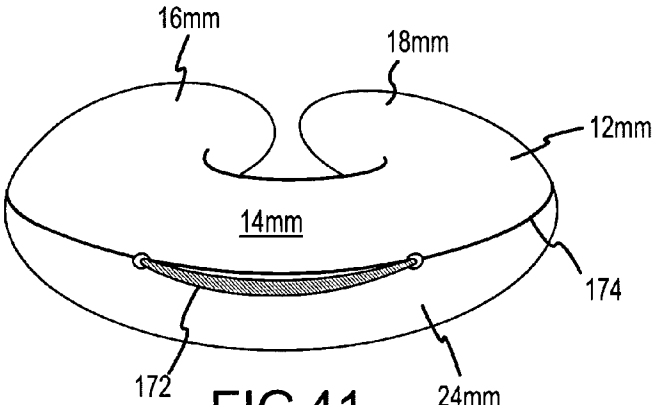
FIG. 41 is a perspective view of one embodiment of a cover that covers a support pillow, with the cover having a handle along the outer periphery at the medial region.

In FIG. 41, a cover 12*mm* is shown with a handle 172 that is coupled to a seam 174 at the outer periphery of medial region 14*mm*. Handle 172 may have essentially any length, from the size of a hand to along the arms of cover 12*mm*.

Figure 42:
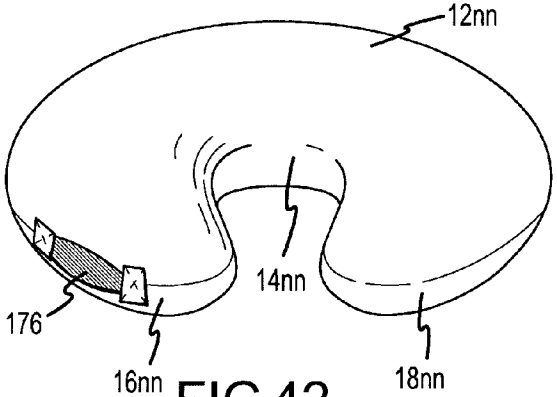
FIG. 42 is a perspective view of one embodiment of a cover that covers a support pillow, with the cover having a handle along the outer periphery along one of the arms.

FIG. 42 illustrates a cover 12*nn* having a handle 176 that is sewn to the outer periphery of arm 16*nn*. As shown, handle 176 is a piece of nylon webbing. Handle 176 may be positioned anywhere on arm 16*nn*, or may also be positioned on arm 18*nn*.

Figure 43:
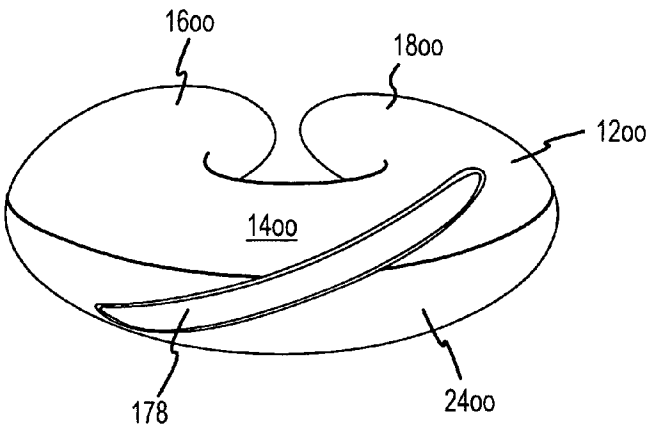
FIG. 43 is a perspective view of one embodiment of a cover that covers a support pillow, with the cover having a handle diagonally positioned along the medial region.

FIG. 43 illustrates a cover 12*oo* having a handle 178 that extends diagonally across the outer periphery 24*oo* of medial region 14*oo*. Handle 178 may be a strip of fabric or any of the handles described herein.

Figure 44:
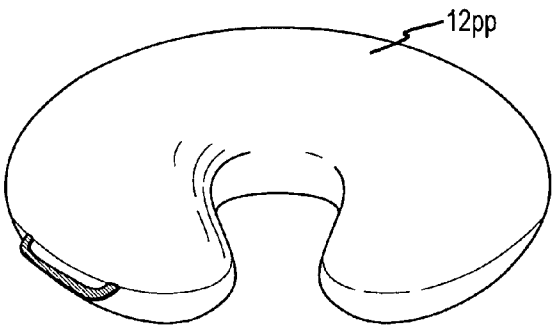
FIG. 44 is a perspective view of one embodiment of a cover that covers a support pillow, with the cover having a handle along one of the arms.

FIG. 44 illustrates a cover 12*pp* having handle 180 that is similar to handle 176 of FIG. 42 except that handle 180 is sewn directly into a seam 182 that joins two pieces of material that form cover 12*pp*.

Figure 45:
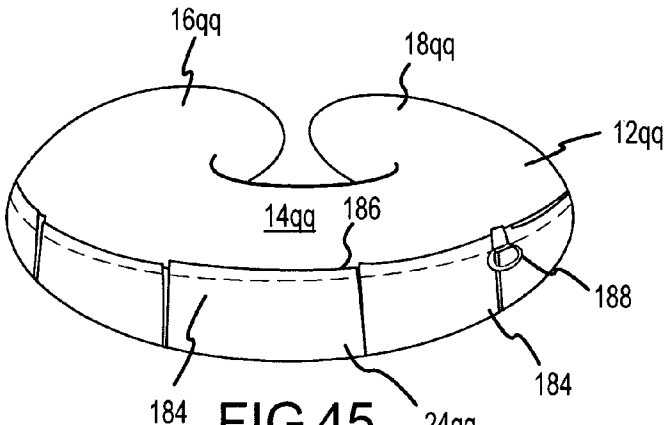
FIG. 45 is a perspective view of one embodiment of a cover that covers a support pillow, with the cover having pockets along the outer periphery at the medial region.

In some embodiments, the covers may be provided with various pockets. These may be provided essentially anywhere on the cover. As one example, FIG. 45 illustrates a cover 12*qq* having a set of pockets 184 along the outer perimeter 24*qq*. These may be only at medial region 14*qq* or may extend along arms 16*qq* and 18*qq*. The pockets 184 have an open top end 186 into which items may be placed. Optionally, one or more fasteners may be used to close the pockets. Further, the pockets may be expandable or stretchable to increase the holding capacity. Examples of items that may be held include toys, wipes, diapers, bottles, burp cloths, pacifiers, accessories and the like. Optionally an attachment 188 may be provided to permit items to be attached to cover 12*qq*.

Figure 46:
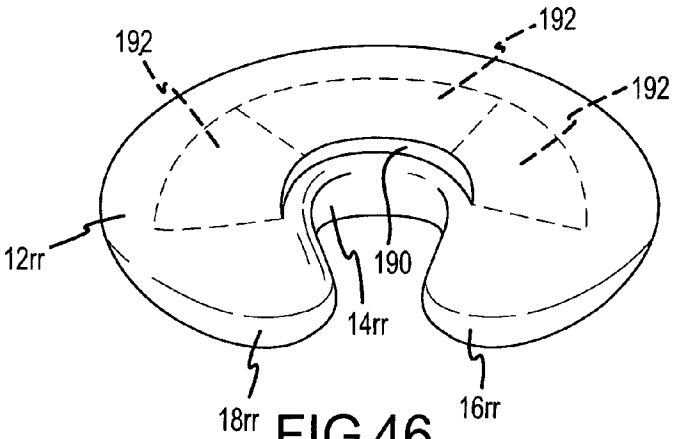
FIG. 46 is a perspective view of one embodiment of a cover that covers a support pillow, with the cover having pockets along the face of the medial region.

FIG. 46 illustrates a cover 12*rr* having an opening 190 providing access to a set of internal pockets 192 that are on a generally flat surface of the pillow. These pockets may be at medial region 14*rr*, as well as along arms 16*rr* and 18*rr* and may be formed using a piece of fabric that is coupled to the inside of cover 12*rr*. Examples of items that may be held in pockets 192 include aromatherapy packs, sound or vibration units, therapeutic magnets, padding and the like.

Figure 47:
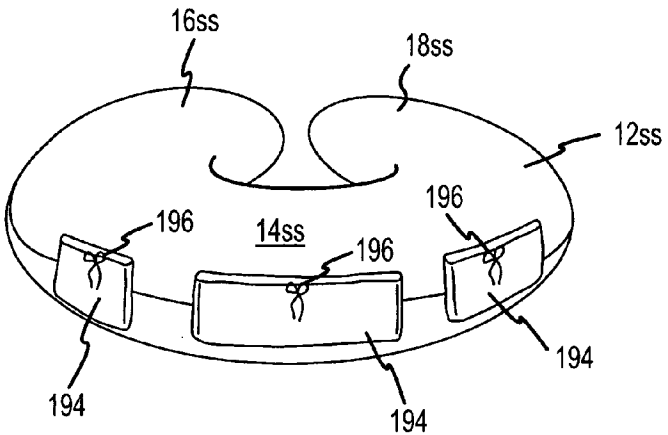
FIG. 47 is a perspective view of one embodiment of a cover that covers a support pillow, with the cover having pockets along the outer periphery at the medial region.

FIG. 47 illustrates a cover 12*ss* having pockets 194 along the outer perimeter 24*ss*. Pockets 194 have ties 196 that may be tied together to close the pockets. Also, other fasteners may be used as described herein.

Figure 48:
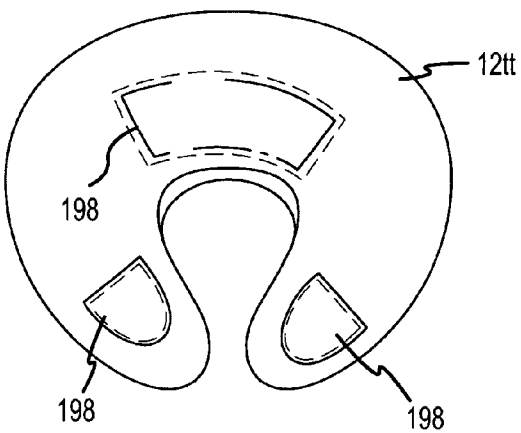
FIG. 48 is a perspective view of one embodiment of a cover that covers a support pillow, with the cover having pockets on the medial region and the arms.

FIG. 48 illustrates a cover 12*tt* having a set of internal pockets 198 for holding items similar to that described in FIG. 46. Although shown with three spaced apart pockets, it will be appreciated that other numbers and spacing may be used.

Figure 49:
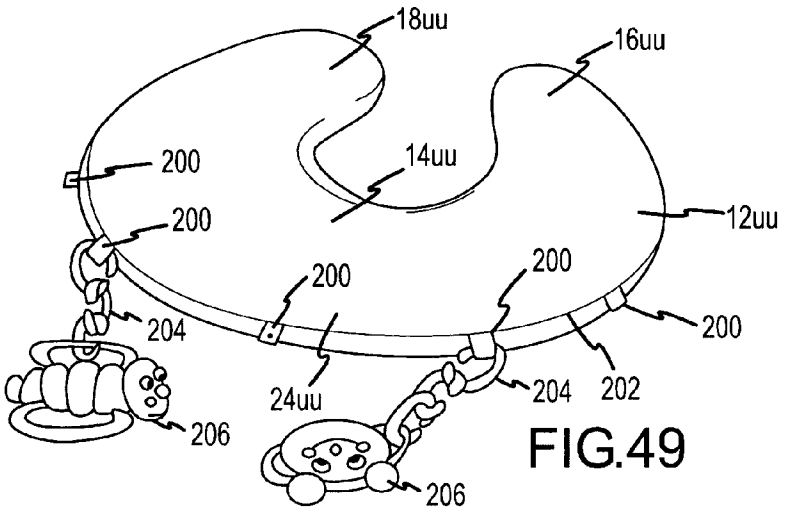
FIG. 49 is a perspective view of one embodiment of a cover that covers a support pillow, with the cover having attachments along the outer periphery that couple toys to the cover.

FIG. 49 illustrates a cover 12*uu* having several attachments 200 for attaching various items to cover 12*uu*. Attachments 200 comprise loops that are sewn into a seam 202 in cover 12*uu*. A variety of items may be coupled to the loops, such as plastic links 204 that are connected to toys 206. This permits toys or other items to be coupled to a pillow by covering the pillow with cover 12*uu*. In this way, a preexisting pillow does not need to be modified to have toys attached. One example of a pillow having attachments is described in U.S. Pat. No. 5,546,620, incorporated herein by reference. With cover 12*uu*, such attachments to do need to be made directly on the pillow, thereby making the pillow more versatile in its uses. Also, it will be appreciated that other attachments may be used including clips, hooks, straps and the like.

Figure 50:
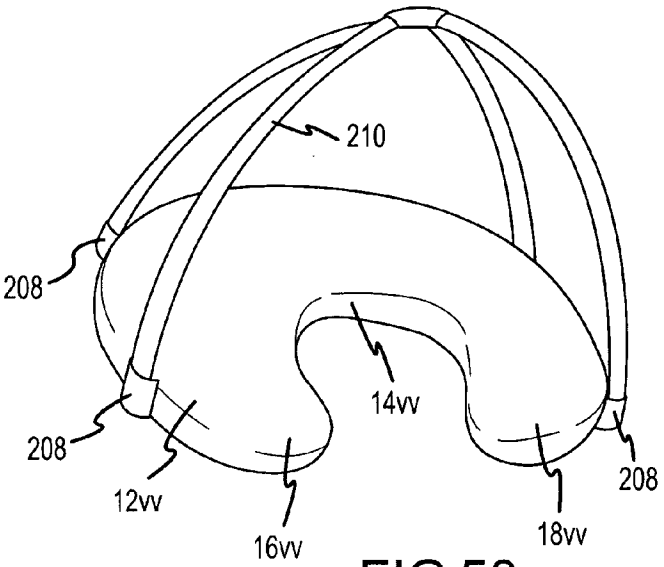
FIG. 50 is a perspective view of one embodiment of a cover that covers a support pillow, with pockets along the outer periphery that couple toy bars to the cover.
Figure 51:
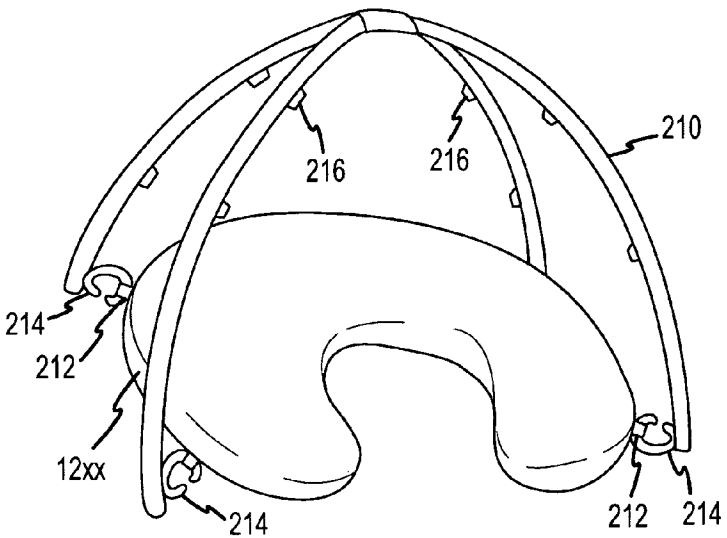
FIG. 51 is a perspective view of another embodiment of a cover that covers a support pillow, with the cover having attachments along the outer periphery that couple toy bars to the cover.

FIG. 50 illustrates a cover 12*vv* covering a pillow. Cover 12*vv* may include an opening and a fastener similar to other embodiments. Cover 12*vv* includes attachments 208 for holding a set of bars 210 above the pillow. Such bars are described in copending U.S. application Ser. No. 09/679,139, filed Oct. 3, 2000 and 09/802,097, filed Mar. 8, 2001, incorporated herein by reference, and may be used to hang items above the pillow. However, with cover 12*vv*, bars 210 may be coupled to the pillow without directly modifying a pillow. In this way, existing pillows may be retrofit to have bars by simply adding cover 12*vv*. As shown, attachments 208 comprise pockets. However, it will be appreciated that other attachments may be used as well. For example, as shown in FIG. 51, loops 212 connected to clips 214 may be used to connect bars 210 to cover 12*xx*. Also, bars 210 may also include attachments 216 that permit items to hang from bars 210. Other attachments that may be used to couple the bars to the cover include ties, straps, ropes and the like.

Figure 52:
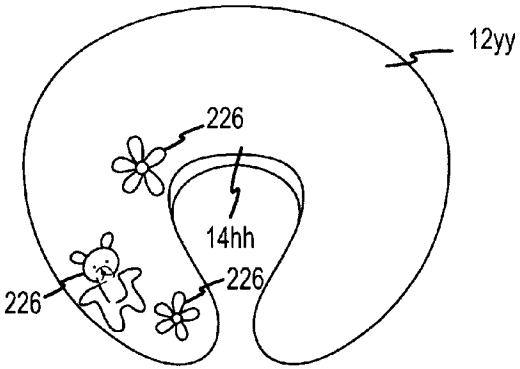
FIG. 52 is a top view of one embodiment of a cover that covers a support pillow, with the cover having one arrangement of appliqués.

Various appliqués may also be added to any of the covers described herein. Some examples of such appliqués are illustrates in FIGS. 52–55. These covers may have openings and fasteners similar to the other covers described herein. In FIG. 52, a cover 12*yy* has a set of objects 226. These may be sewed, glued, painted or the like to cover 12*yy*. As shown, objects 226 are single objects that are separated from each other. However, they could be combined in a scene or connected together.

Figure 53:
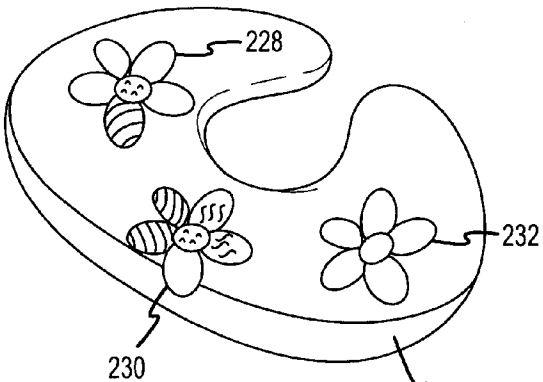
FIG. 53 is a perspective view of one embodiment of a cover that covers a support pillow, with the cover having another arrangement of appliqués.

In FIG. 53, a cover 12*zz* has a set of objects 228, 230 and 232. Object 228 may comprise a crinkle material that crinkles when played with by a baby. Object 230 may be constructed of materials with different textures, such as on each pedal of the flower. Object 232 may be configured to squeak when pressure is applied.

Figure 54:
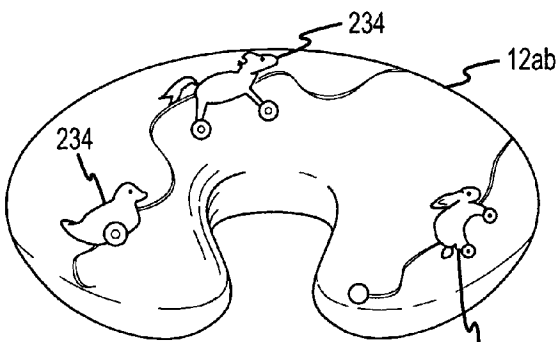
FIG. 54 is a perspective view of one embodiment of a cover that covers a support pillow, with the cover having a further arrangement of appliqués.

FIG. 54 illustrates a cover 12*ab* with a set of connected objects 234 that are similar to cover 12*yy*, but are interconnected.

Figure 55:
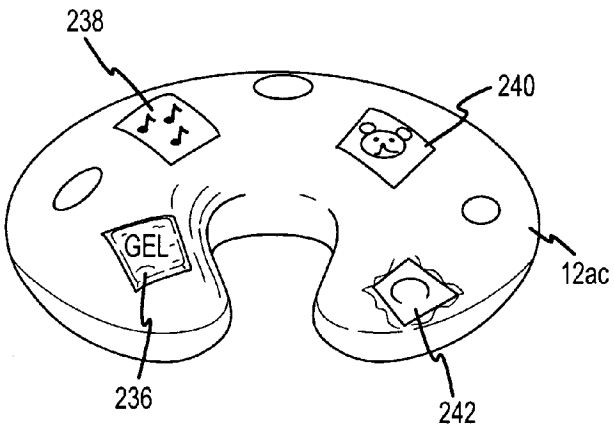
FIG. 55 is a perspective view of one embodiment of a cover that covers a support pillow, with the cover having still a further arrangement of appliqués.

FIG. 55 illustrates a cover 12*ac* having a variety of objects with various features. These objects may be covered with a material or otherwise attached to the cover 12*ac*. Object 236 comprises a gel pack that may be pressed to give a "squishy" feel. Object 238 comprises a pressure sensitive sound chip that produces a sound or music when pressed. Object 240 comprises an appliqué that squeaks when pressed. Object 242 comprises a material that crinkles when touched.

Figure 56:
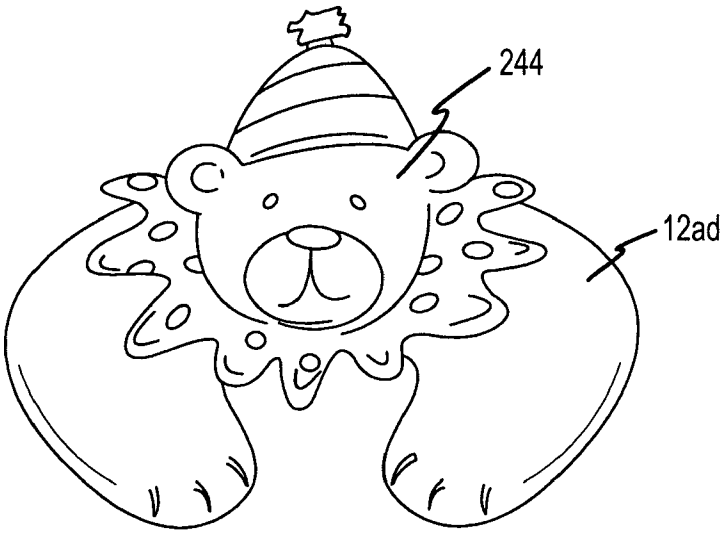
FIG. 56 is a perspective view of a cover having an animal head.

FIG. 56 illustrates a cover 12*ad* having a clown head 244. Cover 12*ad* may include an opening and a fastener to close the opening similar to the other covers described herein. Although shown with a clown head, other items may be used as well, including other characters, body parts, and essentially any other types of object.

Figure 57:
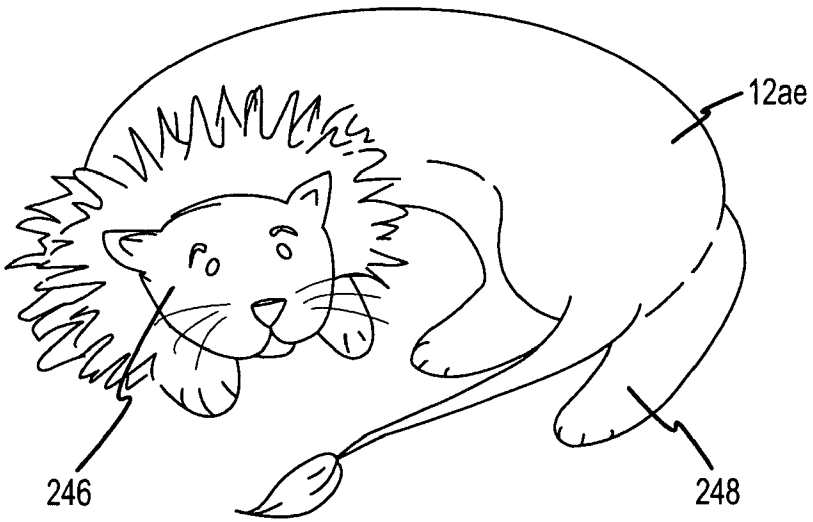
FIG. 57 is a perspective view of a cover in the shape of an animal.

FIG. 57 illustrates a cover 12*ae* in the shape of a lion, including a head 246 and feet 248. Other objects may be used as well. For instance, the cover could include a puppy head and paws and tails on ends of the arms, flower petals and leaves, and the like. Other examples of characters are described in U.S. Pat. No. 6,055,687, incorporated herein by reference.

One advantage of using covers 12*ad* and 12*ae* is that a cover may be used to convert a conventional pillow to have a character or other item. This increases the versatility of a conventional pillow.

Figure 58:
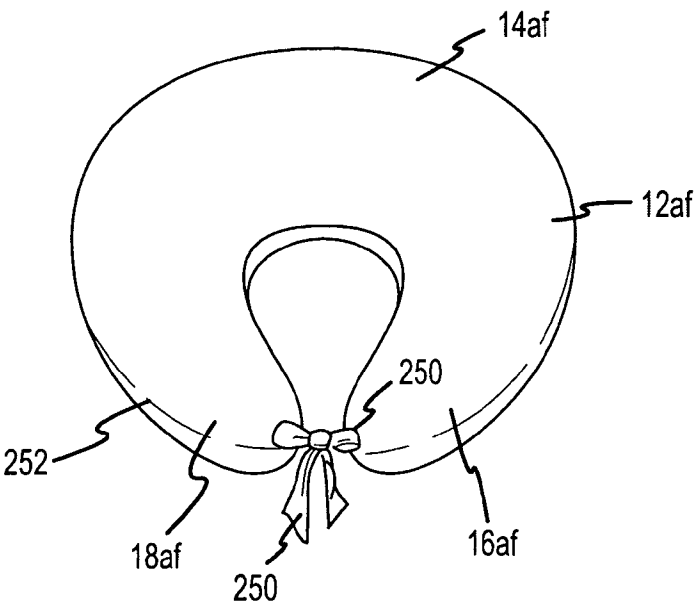
FIG. 58 is a front perspective view of one embodiment of a cover that covers a support pillow, with the cover having ties at the ends of the arms.

FIG. 58 illustrates a cover 12*af* that may be particularly useful with a newborn or a small infant. Cover 12*af* may be placed over a pillow using any of the techniques described herein. Cover 12*af* also includes a pair of ties 250 that are affixed to each end 16*af* and 18*af*. For example, ties 250 could be sewn into a center seam 252 of cover 12*af*. Ties 250 may each have a length of about 4 inches to about 10 inches, and more typically from about 6 to about 7 inches. Materials that may be used for ties 250 include fabric strips, webbing, rope, string, leather straps and the like. In use, ties 250 are crossed and pulled together to pull arms 16*af* and 18*af* together. In so doing, the small infant is better held within the well created by the pillow. Optionally, ties 250 may be tied in the shape of a bow, or may use some other type of knot. As another alternative, various connectors or fasteners may be used to keep the arms close to each other. For example, the arms could be pulled together and then held in place using a buckle (such as on a backpack strap), or cinched together using a grip buckle. Other possible buckles or fasteners include press buckles, twist locks, slip locks, tuck buckles, cord locks, a hook and loop fastener material and the like.

Figure 59:
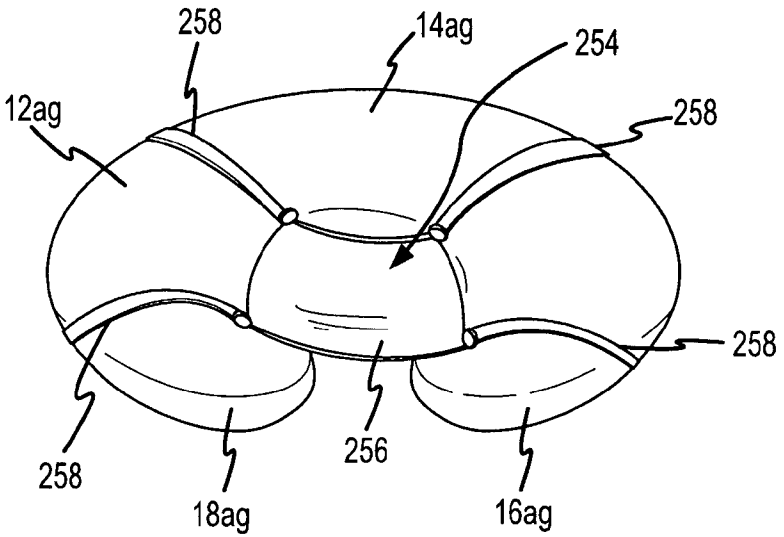
FIG. 59 is a front perspective view of one embodiment of a cover that covers a support pillow, with the cover having a harness.

FIG. 59 illustrates a cover 12*ag* having a harness 254. Harness 254 has a holding region 256 onto which the infant is rested and extends over the well region. For example, the infant could be place in a supine position on holding region 256, with the harness 254 holding the infant off the ground. A variety of techniques may be used to couple harness 254 to cover 12*ag*. For example, harness 254 could be permanently attached to cover 12*ag*, or could be removable (in which case harness 254 could be placed directly onto a pillow that does not have a cover). As shown, harness 254 includes a set of straps 258 that are coupled to holding region 256. Straps 258 could be sewn or glued to cover 12*ag*, or simply looped around arms 16*ag* and 18*ag* and/or medial region 14*ag*. Further, instead of using straps, other materials could be used, such as a webbing material, a wide piece of fabric or the like. In some cases, holding region 256 could be directly coupled to cover 12*ag*, such as by sewing.

Figure 60:
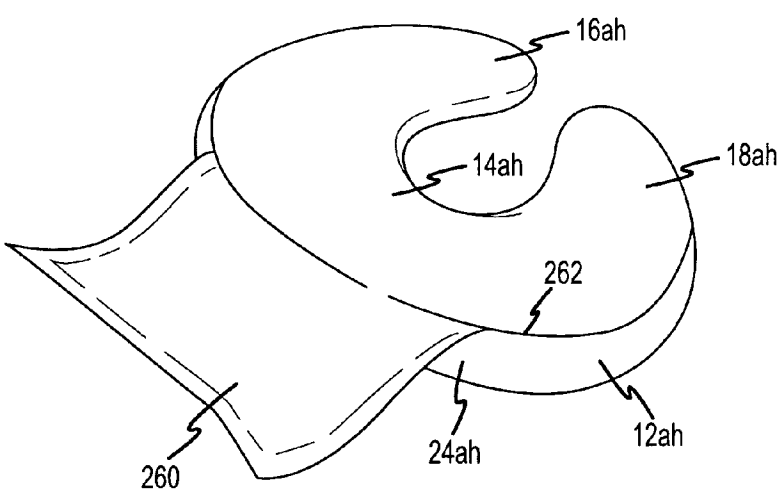
FIG. 60 is a perspective view of one embodiment of a cover that covers a support pillow, with the cover having a blanket coupled thereto.

FIG. 60 illustrates a cover 12*ah* that may be placed over a pillow using any of the techniques described herein. Attached to cover 12*ah* is a blanket 260 that may be used to permit a child to lay on the floor, similar to that described in U.S. Pat. Nos. 5,546,620 and 6,523,200, incorporated herein by reference. As shown, cover 260 is sewed into a seam 262; however, it will be appreciated that other techniques may be used, such as by gluing, buttons, snaps, and the like. Also, in some cases, blanket 260 may be removable from cover 12*ah*. By using cover 12*ah*, a pillow may be converted to have a blanket, simply by placing cover 12*ah* over the pillow. Blanket 260 may extend anywhere along outer periphery 24*ah*, and may have a length sufficient to hold a baby. For example, the length could be from about 18 inches to about 3 feet.

Figure 61:
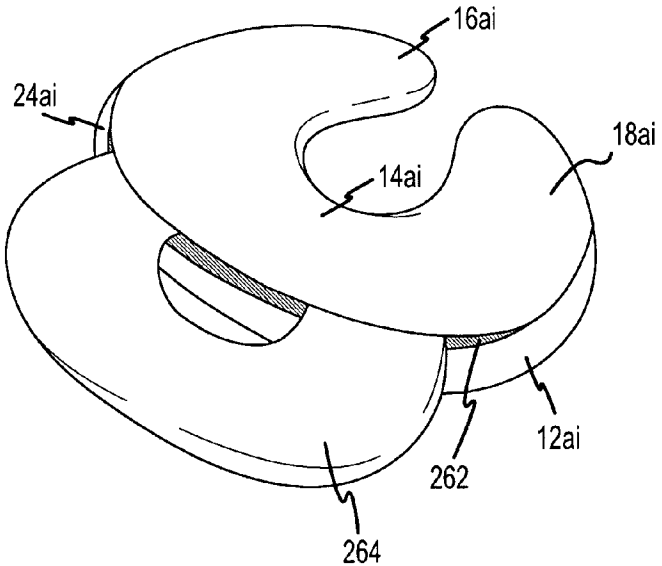
FIG. 61 is a rear perspective view of one embodiment of a cover that covers a support pillow, with the cover having an internal pocket for holding a padding layer.

FIG. 61 illustrates a cover 12*ai* that may be attached to a pillow using any of the techniques described herein. In one particular arrangement, cover 12*ai* may have an opening 262 where the pillow may be inserted. Opening 262 also permits a padding layer 264 (having the same general shape as the pillow) to be inserted between the pillow and cover 12*ai*. In some cases, a pocket may be coupled to cover 12*ai* to hold padding layer 264 in position.

Padding layer 264 may be used to raise the height of the pillow, give it a slightly different shape or simply provide a different type of padding. For example, padding layer 264 may comprise one or more layers of polyurethane foam, foam rubber, a visco-elastic material, or the like and may have a height in the range from about ½ inch to about 5 inches. In some cases, the surface of padding layer 264 could be angled or contoured to alter the shape of the pillow. In other cases, padding layer 264 may be constructed of a relatively dense or stiff material to increase the firmness of the pillow. Also, padding layers of different sizes may be used to adjust the shape of the pillow.

Figure 63:
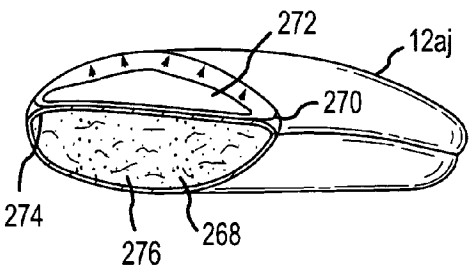
FIG. 63 is a cross-sectional view of the pillow and cover of FIG. 62 taken along lines 62—62.
Figure 62:
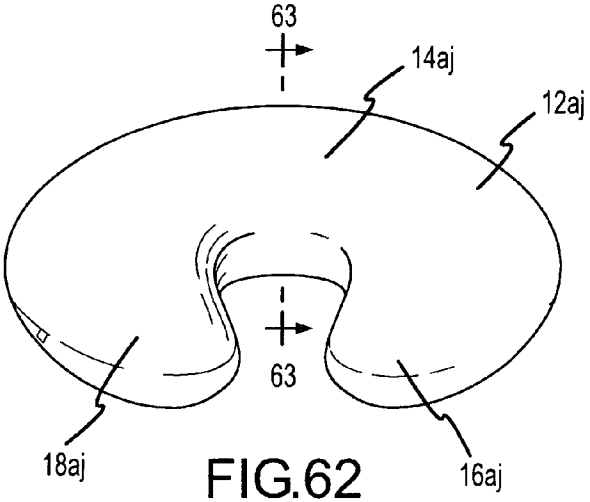
FIG. 62 is a perspective view of one embodiment of a cover that covers a support pillow, and an inflatable bladder between the cover and the pillow.

FIGS. 62 and 63 illustrate a cover 12*aj* that may be placed over a pillow 268 using any of the techniques described herein. Cover 12*aj* includes an optional interior pocket 270 for holding an inflatable bladder 272. Alternatively, bladder 272 could be placed directly between the shell 274 that encompasses the fill material 276 of pillow 266 and cover 12*aj*. Also, cover 12*aj* may include an opening similar to cover 12*ai* for inserting and removing bladder 272. When inflated, bladder 272 expands as illustrated by the arrows. Bladder 272 may be inflated with air, a liquid, or the like and may be inflated to different pressures to adjust the firmness and or shape of the pillow. Further multiple bladders of different sizes and shapes may be used.

Figure 64:
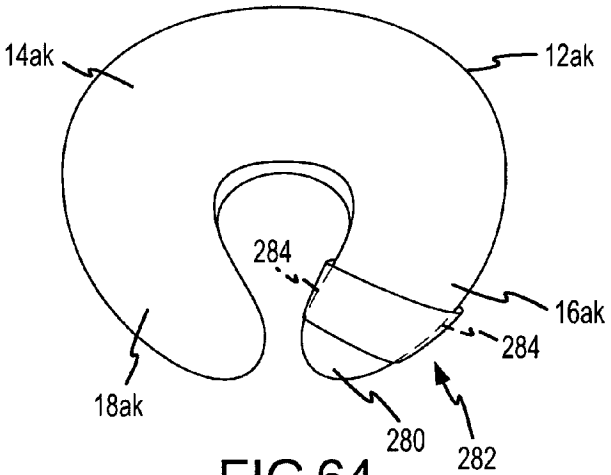
FIG. 64 is a top view of one embodiment of a cover that covers a support pillow, with the cover having a reversible pocket at one end for closing the cover over the pillow.
Figure 65:
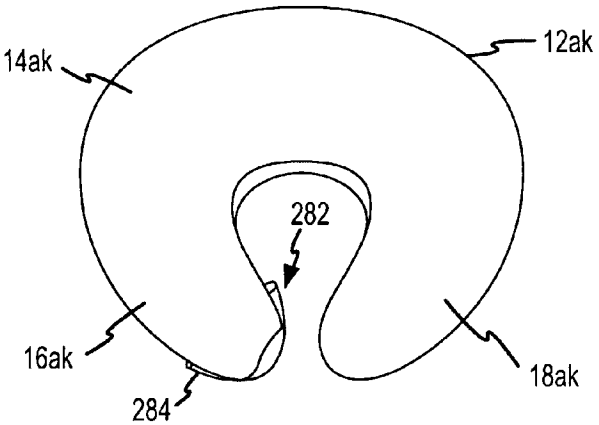
FIG. 65 is a bottom view of the pillow and cover of FIG. 64.
Figure 66:
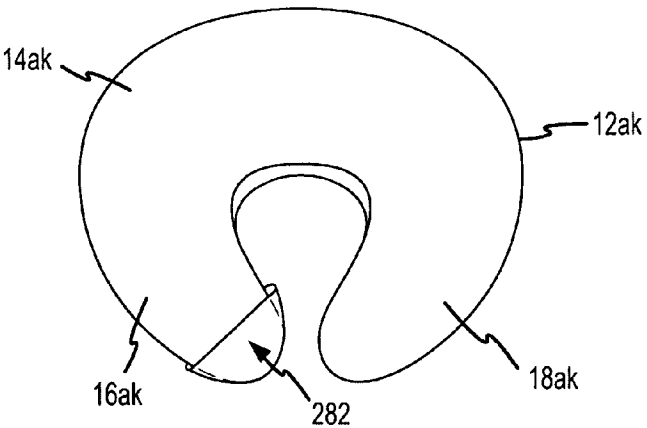
FIG. 66 illustrates the pillow and cover of FIG. 65 once the pocket has been inverted and placed over the end of the pillow.

FIG. 64 illustrates another embodiment of a cover 12*ak* that may be placed over a pillow 280. Cover 12*ak* has two ends, 16*ak* and 18*ak*, one or both of which may have an open end. At the open end is a reversible pocket 282 (such as at end 16*ak*). Pocket 282 is sewn (or otherwise affixed) to sides 284 of cover 12*ak* in a reversed orientation. By having end 16*ak* open, pillow 280 may be inserted into cover 12*ak* through the open end. To close cover 12*ak*, pocket 282 is reversed to the position illustrated in FIGS. 65 and 66 where it is folded over the end of the pillow to enclose the pillow. In this way, pocket 282 operates somewhat similar to a traditional sandwich bag. To remove pillow 280, pocket 282 is simply reversed back to the position illustrated in FIG. 64 and pillow 280 is pulled through the open end.

The invention has now been described in detail for purposes of clarity and understanding. However, it will be appreciated that certain changes and modification may be practiced within the scope of the appended claims.

What is claimed is:

1. A support pillow comprising:

a cushion body having a medial region and two opposing arms that define a generally open well, with the cushion body having an outer periphery and an inner periphery adjacent the well, and wherein each of the arms terminates in an end, wherein the cushion body comprises a fill material compressed and enclosed within a fabric shell and has a top surface and a bottom surface; and a fabric cover disposed over the cushion body such that the fabric cover conforms generally to the shape of the cushion body, wherein the fabric cover includes at least one pocket disposed along the outer periphery of the cushion body, wherein the pocket comprises a length of fabric that is coupled to the cover such that the pocket extends from the bottom surface to the top surface, has an open top end at the top surface and extends substantially along the entire medial region, wherein the pocket is subdivided into a plurality of sub-pockets by dividers that extending vertically from the bottom surface to the top surface and wherein the pocket is expandable.

2. A pillow as in claim 1, wherein the pocket further extends along the opposing arms.

3. A pillow as in claim 1, further comprising at least one attachment secured to the cover.

4. A pillow as in claim 1, further comprising an opening to permit the cover to be placed over the shell, and wherein the cover includes at least one fastener to close the opening once the cover has been placed over the shell.

5. A support pillow as in claim 4, wherein the fastener is selected from a group of fasteners consisting of zippers, ties, buttons, buckles, a hook and loop fastener material, snaps, reversible pockets and hooks.

6. A support pillow as in claim 1, further comprising a pair of ties coupled to the cover so as to be positioned at the ends of the arms, whereby the arms may be pulled together by tying the ties.

7. A covering for a support pillow comprising a cushion body having a medial region and two opposing arms that define a generally open well, with the cushion body having an outer periphery and an inner periphery adjacent the well, and wherein each of the arms terminates in an end, wherein the cushion body comprises a fill material compressed and enclosed within a fabric shell and has a top surface and a bottom surface, the covering comprising a fabric cover that is adapted to be removably disposed over the pillow such that the fabric cover conforms generally to the shape of the cushion body, wherein the fabric cover includes at least one pocket disposed along the outer periphery of the cushion body, wherein the pocket comprises a length of fabric that is coupled to the cover such that the pocket extends from the bottom surface to the top surface, has an open top end at the top surface and extends substantially along the entire medial region, wherein the pocket is subdivided into a plurality of sub-pockets by dividers that extending vertically from the bottom surface to the top surface and wherein the pocket is expandable.

8. A covering as in claim 7, wherein the pocket further extends along the opposing arms.

9. A covering as in claim 8, further comprising an opening to permit the cover to be placed over the cushion body, and wherein the cover includes at least one fastener to close the opening once the cover has been placed over the cushion body.

10. A support pillow comprising:

a cushion body having a medial region and two opposing arms that define a generally open well, with the cushion body having an outer periphery and an inner periphery adjacent the well, and wherein each of the arms terminates in an end, wherein the cushion body comprises a fill material compressed and enclosed within a fabric shell and has a top surface and a bottom surface; and a fabric cover disposed over the cushion body such that the fabric cover conforms generally to the shape of the cushion body, wherein the fabric cover includes an elongate pocket extending along the outer periphery of the cushion body at the medial region, wherein the pocket comprises a length of fabric that is coupled to the cover such that the pocket extends from the bottom surface to the top surface, has an open top end at the top surface and extends substantially along the entire medial region, wherein the pocket is divided into multiple segments by dividers that extending vertically from the bottom surface to the top surface and wherein the pocket is expandable.

* * * * *